US009142343B2

(12) United States Patent
Ohkubo et al.

(10) Patent No.: US 9,142,343 B2
(45) Date of Patent: Sep. 22, 2015

(54) COIL COMPONENT

(71) Applicant: TDK Corporation, Tokyo (JP)

(72) Inventors: Hitoshi Ohkubo, Tokyo (JP); Tomokazu Ito, Tokyo (JP); Hideto Itoh, Tokyo (JP); Yoshihiro Maeda, Tokyo (JP); Manabu Ohta, Tokyo (JP); Yuuya Kaname, Tokyo (JP); Takahiro Kawahara, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/935,442

(22) Filed: Jul. 3, 2013

(65) Prior Publication Data

US 2014/0009254 A1 Jan. 9, 2014

(30) Foreign Application Priority Data

Jul. 4, 2012 (JP) ..... 2012-150448
Mar. 29, 2013 (JP) ..... 2013-072034

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 17/00*** | (2006.01) |
| ***H01F 27/02*** | (2006.01) |
| ***H01F 27/255*** | (2006.01) |

(52) U.S. Cl.

CPC ..... *H01F 27/2804* (2013.01); *H01F 17/0033* (2013.01); *H01F 27/022* (2013.01); *H01F 27/255* (2013.01); *H01F 27/292* (2013.01); *H01F 2017/0073* (2013.01)

(58) Field of Classification Search

CPC ..... H01F 5/04; H01F 27/292; H01F 41/10; H01F 27/29; H01F 27/027

USPC ..... 336/200, 223, 232, 230

See application file for complete search history.

(56) References Cited

U.S. PATENT DOCUMENTS

| | | | | |
|---|---|---|---|---|
| 6,392,297 | B2 * | 5/2002 | Seto | 257/701 |
| 6,618,929 | B2 * | 9/2003 | Kitamura | 29/602.1 |
| 7,696,849 | B2 * | 4/2010 | Ito et al. | 336/192 |
| 7,843,701 | B2 * | 11/2010 | Kudo et al. | 361/760 |
| 8,050,045 | B2 * | 11/2011 | Okuzawa et al. | 361/763 |
| 8,416,048 | B2 | 4/2013 | Tawa | |

(Continued)

FOREIGN PATENT DOCUMENTS

| | | | |
|---|---|---|---|
| JP | 2006-066830 | A | 3/2006 |
| JP | 2011-009391 | A | 1/2011 |
| JP | 4873049 | B2 | 2/2012 |

*Primary Examiner* — Elvin G Enad
*Assistant Examiner* — Kazi Hossain
(74) *Attorney, Agent, or Firm* — McDermott Will & Emery LLP

(57) ABSTRACT

A coil component 1 includes a substrate 2, a planar spiral conductor 10*a* formed on a top surface 2*t* of the substrate 2, a lead conductor 11*a* connected to an outer peripheral end of the planar spiral conductor 10*a*, a dummy lead conductor 15*a* formed on the top surface of the substrate 2 and between an outermost turn of the planar spiral conductor 10*a* and an end $2X_2$ of the substrate 2 and free from an electrical connection with another conductor within the same plane, external electrodes 26*a* and 26*b* arranged in parallel with the top surface of the substrate 2, and a bump electrode 25*a* formed on a surface of the lead conductor 11*a* and connects the lead conductor 11*a* with the external electrode 26*a*. The external terminals 26*a* and 26*b* have a larger area than the bump electrodes 15*a* and 15*b* for securing a bonding strength.

18 Claims, 22 Drawing Sheets

(56) References Cited

U.S. PATENT DOCUMENTS

| | | | | |
|---|---|---|---|---|
| 8,505,192 | B2 * | 8/2013 | Chu | 29/602.1 |
| 8,633,793 | B1 * | 1/2014 | Chang et al. | 336/200 |
| 2001/0026017 | A1 * | 10/2001 | Seto | 257/736 |
| 2007/0040163 | A1 * | 2/2007 | Okuzawa et al. | 257/31 |
| 2007/0199734 | A1 * | 8/2007 | Kudo et al. | 174/255 |
| 2008/0100409 | A1 * | 5/2008 | Nishikawa et al. | 336/200 |
| 2008/0303621 | A1 * | 12/2008 | Ito et al. | 336/200 |
| 2010/0157565 | A1 * | 6/2010 | Yoshida et al. | 361/811 |
| 2010/0328009 | A1 | 12/2010 | Tawa | |
| 2011/0025442 | A1 * | 2/2011 | Hsieh et al. | 336/200 |
| 2012/0119863 | A1 * | 5/2012 | Wu | 336/192 |
| 2012/0133472 | A1 * | 5/2012 | Nishikawa et al. | 336/200 |
| 2013/0222101 | A1 * | 8/2013 | Ito et al. | 336/83 |

* cited by examiner

COIL COMPONENT

BACKGROUND OF THE INVENTION

1. Field of the Invention

The present invention relates to a coil component. In particular, the present invention relates to a coil component including a planar spiral conductor formed on a printed-circuit board by electrolytic plating and a method for manufacturing the same.

2. Description of Related Art

In the field of consumer and industrial electronic devices, surface-mounting type coil components have been used more and more as power supply inductors. The reason is that surface-mounting type coil components are small and thin, provide excellent electrical insulation, and can be manufactured at low cost.

Among specific structures of a surface-mounting type coil component is a planar coil structure using printed-circuit board technology (for example, see Japanese Patent No. 4873049). The structure will be briefly described in terms of manufacturing steps. Initially, a seed layer (base film) having a planar spiral shape is formed on a printed-circuit board. The printed-circuit board is then immersed into a plating solution and a direct current (hereinafter, referred to as "plating current") is passed through the seed layer, whereby metal ions in the plating solution are electrodeposited on the seed layer. This forms a planar spiral conductor. An insulating resin layer which covers the formed planar spiral conductor and a metal magnetic powder-containing resin layer which serves as a protective layer and a magnetic path are then formed in succession to complete the coil component. Such a structure can maintain dimensional and positional accuracies at extremely high values, and allows a reduction in size and thickness. Japanese Patent Application Laid-Open No. 2006-66830 discloses a planar coil element having such a planar coil structure.

The purpose of using the foregoing electrolytic plating for the formation of the conductor is to make the conductor thickness of the planar spiral conductor as large as possible. The applicants then perform special plating that the applicants call "HAP" (High Aspect Plating) to allow a further increase in the conductor thickness.

HAP uses a current higher than heretofore for electrolytic plating to quickly grow a plating layer of electrodeposited metal ions. This can provide a thicker plating layer than theretofore, whereby the conductor thickness of the planar spiral conductor can be made greater than heretofore.

However, HAP can sometimes cause an abnormal lateral growth of the plating layer at a portion corresponding to the outermost turn of the planar spiral conductor. More specifically, in HAP, the high plating current tends to grow the plating layer in lateral directions. If there is any other adjoining seed layer, the lateral growth is suppressed by the presence of the plating layer growing on the other adjoining seed layer. On the other hand, if there is no other adjoining seed layer like the outermost turn of the planar spiral conductor, nothing suppresses the lateral growth. The outermost turn therefore becomes excessively large in line width, causing the problem that a desired spiral pattern cannot be formed. The lateral growth needs to be prevented in particular because such a pattern can deteriorate the characteristics of the coil component.

To meet a demand for high-density mounting, it is needed to reduce the area occupied by the coil component while securing a desired mounting strength of the coil component.

In particular, it is needed to secure a desired mounting strength with a minimum amount of solder for reduced material cost.

For high-density mounting, an external electrode structure where electrode surfaces are formed only on the chip bottom has been increasingly used recently. The omission of electrode surfaces from the side surfaces of a chip precludes the formation of solder fillets, whereby the area occupied by the chip component can be reduced. If a coil component has the electrode structure including only bottom electrodes, the ends of the planar spiral conductor need to be led out to the bottom side of the chip component and connected to the external electrodes instead of being led out to lateral sides of the chip. This needs some contrivance to the electrode structure. In particular, the bottom electrodes need to have a sufficient area to provide a bonding strength at the time of surface mounting.

SUMMARY

It is therefore an object of the present invention to provide a coil component that can prevent the outermost turn of a planar spiral conductor from being largely deformed in shape and that allows the formation of external electrodes only on the chip bottom, and a method for manufacturing the same.

Another object of the present invention is to provide a coil component that prevents the outermost turn of a planar spiral conductor from being largely deformed in shape and that can provide a desired mounting strength with a small amount of solder at the time of surface mounting.

To solve the foregoing problems, a coil component according to the present invention includes: a substrate; a planar spiral conductor that is formed on a surface of the substrate by electrolytic plating; a lead conductor that is formed on the surface of the substrate and connected to an outer peripheral end of the planar spiral conductor; a dummy lead conductor that is formed on the surface of the substrate and between an outermost turn of the planar spiral conductor and an end of the substrate, and is free from an electrical connection with another conductor at least within the same plane; an external electrode that is formed in parallel with the surface of the substrate; and a bump electrode that is formed on a surface of the lead conductor by electrolytic plating and connects the lead conductor with the external electrode, wherein the external electrode has an area greater than that of the bump electrode.

According to the present invention, the dummy lead conductor is arranged between the outermost turn of the planar spiral conductor and the end of the substrate. This can suppress the lateral growth of a plating layer constituting the outermost turn of the planar spiral conductor in the electrolytic plating step. The outermost turn of the planar spiral conductor can thus be suppressed from becoming extremely large in the line width. Moreover, according to the present invention, the planar spiral conductor and the external electrode can be connected via the bump electrode. The external electrode having a larger area than the bump electrode can be used to provide a desired mounting strength at the time of surface mounting.

In the present invention, the planar spiral conductor may have a circular spiral shape. A side surface of the dummy lead conductor opposed to the planar spiral conductor may be curved along the outermost turn of the planar spiral conductor. If the side surface of the dummy lead conductor has such a curved shape, the lateral growth of the plating layer constituting the outermost turn of the planar spiral conductor can be reliably suppressed. This allows the formation of a high-precision pattern. The line width of the outermost turn can be made the same as that of inner turns.

The coil component according to the present invention may further include: an insulating resin layer that covers the planar spiral conductor, the lead conductor, and the dummy lead conductor; and a metal magnetic powder-containing resin layer that covers the surface of the substrate from above the insulating resin layer. The external electrode may be formed not on a side surface but selectively on a main surface of the metal magnetic powder-containing resin layer. The bump electrode may penetrate the insulating resin layer and the metal magnetic powder-containing resin layer and be connected to the external electrode. According to such a configuration, a power supply choke coil having an excellent direct-current superimposition characteristic can be provided. In addition, an electrode structure including only bottom electrodes without the formation of solder fillets on chip sides can be formed to meet the recent demand for high-density mounting.

The coil component according to the present invention may further include first and second through-hole magnetic bodies that are made of the same material as that of the metal magnetic powder-containing resin layer. The first through-hole magnetic body may penetrate the substrate in a center portion surrounded by the planar spiral conductor. The second through-hole magnetic body may penetrate the substrate outside the planar spiral conductor. According to such a configuration, the direct-current superimposition characteristic of the coil can be further improved.

In the present invention, the substrate may have a rectangular shape. The planar spiral conductor may have an elliptical spiral shape. The second through-hole magnetic bodies may be formed corresponding to each of four corners of the substrate. Such a configuration can maximize the forming area of the coil within limited dimensions while securing the forming areas of the through-hole magnetic bodies. The inductance and the direct-current superimposition characteristic of the coil both can thus be improved.

In the present invention, the substrate may include first and second sides that are parallel to each other, and third and fourth sides that are orthogonal to the first and second sides and parallel to each other. The lead conductor may be extended along the first side. The dummy lead conductor may be extended along the second side. The second through-hole magnetic bodies may be arranged on the third or fourth sides. According to such a configuration, the forming areas of the lead conductor and the dummy lead conductor are not restricted by the second through-hole magnetic bodies. The lead conductor can thus be extended from one end to the other of the first side. The dummy lead conductor can be extended from one end to the other of the second side.

In the present invention, the bump electrode may be extended along the first side with the lead conductor. Such a configuration can improve the formation yield of the bump electrode and reduce the time of the plating growth.

A coil component according to another aspect of the present invention includes: a substrate having top and bottom surfaces; a first planar spiral conductor that is formed on the top surface of the substrate by electrolytic plating; a second planar spiral conductor that is formed on the bottom surface of the substrate by electrolytic plating; a first through-hole conductor that penetrates the substrate to connect an inner peripheral end of the first planar spiral conductor with an inner peripheral end of the second planar spiral conductor; a first dummy lead conductor that is formed on the top surface of the substrate and between an outermost turn of the first planar spiral conductor and an end of the substrate, and is free from an electrical connection with another conductor at least within the same plane; a second dummy lead conductor that is formed on the bottom surface of the substrate and between an outermost turn of the second planar spiral conductor and an end of the substrate, and is free from an electrical connection with another conductor at least within the same plane; a first lead conductor that is formed on the top surface of the substrate and vertically overlapped with the second dummy lead conductor, and is connected to an outer peripheral end of the first planar spiral conductor; a second lead conductor that is formed on the bottom surface of the substrate and vertically overlapped with the first dummy lead conductor, and is connected to an outer peripheral end of the second planar spiral conductor; a second through-hole conductor that penetrates the substrate to connect the first dummy lead conductor with the second lead conductor; first and second external electrodes that are formed in parallel with the top surface of the substrate; a first bump electrode that is formed on a surface of the first lead conductor by electrolytic plating and connects the first lead conductor with the first external electrode; and a second bump electrode that is formed on a surface of the first dummy lead conductor by electrolytic plating and connects the first dummy lead conductor with the second external electrode, wherein the first external electrode has an area greater than that of the first bump electrode, and the second external electrode has an area greater than that of the second bump electrode.

According to the present invention, the first and second dummy lead conductors are arranged between the outermost turns of the first and second planar spiral conductors and the ends of the substrate, respectively. This can suppress the lateral growth of the plating layers constituting the outermost turns of the first and second planar spiral conductors in the electrolytic plating steps. The outermost turns of the first and second planar spiral conductors can thus be prevented from becoming extremely large in the line width. According to the present invention, the first planar spiral conductor and the first external electrode can be connected via the first bump electrode. The second planar spiral conductor and the second external electrode can be connected via the second bump electrode. The first and second external electrodes having a larger area than the first and second bump electrodes can be used to provide a desired mounting strength at the time of surface mounting.

In the present invention, the first and second planar spiral conductors may have a circular spiral shape. A side surface of the first dummy lead conductor opposed to the first planar spiral conductor maybe curved along the outermost turn of the first planar spiral conductor. A side surface of the second dummy lead conductor opposed to the second planar spiral conductor may be curved along the outermost turn of the second planar spiral conductor. If the side surfaces of the first and second dummy lead conductors have such a curved shape, the lateral growth of the plating layers constituting the outermost turns of the first and second planar spiral conductors can be reliably suppressed. This allows the formation of high-precision patterns. The line widths of the outermost turns can be made the same as those of inner turns.

The coil component according to the present invention may include: a first metal magnetic powder-containing resin layer that is arranged on a top surface side of the substrate; and a second metal magnetic powder-containing resin layer that is arranged on a bottom surface side of the substrate. The first and second external electrodes may be formed not on a side surface but selectively on a main surface of the first metal magnetic powder-containing resin layer. The first and second bump electrodes may penetrate the first metal magnetic powder-containing resin layer and be connected to the first and second electrode external electrodes, respectively. According to such a configuration, a power supply choke coil having an excellent direct-current superimposition characteristic can be provided. In addition, an electrode structure including only bottom electrodes without the formation of solder fillets on chip sides can be formed to meet the recent demand for high-density mounting.

The coil component according to the present invention may further include first and second through-hole magnetic bodies that are made of the same material as that of the first and second metal magnetic powder-containing resin layers, and penetrate the substrate to connect the first metal magnetic powder-containing resin layer with the second metal magnetic powder-containing resin layer. The first through-hole magnetic body may penetrate the substrate in a center portion surrounded by the first and second planar spiral conductors. The second through-hole magnetic bodies may penetrate the substrate outside the first and second planar spiral conductors. Such a configuration can further improve the direct-current superimposition characteristic of the coil.

In the present invention, the substrate may have a rectangular shape. The first and second planar spiral conductors may have an elliptical spiral shape. The second through-hole magnetic bodies may be formed corresponding to each of four corners of the substrate. Such a configuration can maximize the forming area of the coils within limited dimensions while securing the forming areas of the through-hole magnetic bodies. The inductance and the direct-current superimposition characteristic of the coil both can thus be improved.

A method for manufacturing a coil component according to the present invention includes: a first plating step of forming a planar spiral conductor, a lead conductor, and a dummy lead conductor on a surface of a substrate, the lead conductor being connected to an outer peripheral end of the planar spiral conductor, the dummy lead conductor being formed between the planar spiral conductor and an end of the substrate and free from an electrical connection with another conductor at least within the same plane; a second plating step of electrodepositing a metal ion on the planar spiral conductor, the lead conductor, and the dummy lead conductor; a third plating step of forming a bump electrode at least on a part of a surface of the lead conductor; an insulating resin layer forming step of forming an insulating resin layer that covers the planar spiral conductor, the lead conductor, the dummy lead conductor, and the bump electrode; a metal magnetic powder-containing resin layer forming step of forming a metal magnetic powder-containing resin layer that covers the insulating resin layer; a polishing step of polishing a main surface of the metal magnetic powder-containing resin layer to expose an end portion of the bump electrode; and an external electrode forming step of forming an external electrode on the main surface of the metal magnetic powder-containing resin layer, the external electrode having an area larger than that of the end portion of the bump electrode and being connected to the end portion.

In the present invention, the first plating step may include steps of: forming a first planar spiral conductor, a first lead conductor, and a first dummy lead conductor on a top surface of the substrate, the first lead conductor being connected to an outer peripheral end of the first planar spiral conductor, the first dummy lead conductor being formed in an area between an outermost turn of the first planar spiral conductor and an end of the substrate and, being free from an electrical connection with the first planar spiral conductor; forming a second planar spiral conductor, a second lead conductor, and a second dummy lead conductor on a bottom surface of the substrate, the second lead conductor being connected to an outer peripheral end of the second planar spiral conductor, the second dummy lead conductor being formed in an area between an outermost turn of the second planar spiral conductor and an end of the substrate and free from an electrical connection with the second planar spiral conductor; forming a first through-hole conductor that penetrates the substrate to connect an inner peripheral end of the first planar spiral conductor with an inner peripheral end of the second planar spiral conductor; and forming a second through-hole that penetrates the substrate to connect the first dummy lead conductor with the second lead conductor. The third plating step may include a step of forming a first bump electrode that is connected to the first lead conductor and a second bump electrode that is connected to the first dummy lead conductor. The external electrode forming step may include a step of forming a first external electrode that is connected to the first bump electrode and a second external electrode that is connected to the second bump electrode. The first dummy lead conductor may be vertically overlapped with the second lead conductor. The second dummy lead conductor may be vertically overlapped with the first lead conductor.

In the present invention, the metal magnetic powder-containing resin layer forming step may include a step of forming first and second through-hole magnetic bodies that are made of the same material as that of the metal magnetic powder-containing resin layer. The first through-hole magnetic body may penetrate the substrate in a center portion surrounded by the planar spiral conductor. The second through-hole magnetic bodies may penetrate the substrate outside the planar spiral conductor. As a result, a power supply choke coil having an excellent direct-current superimposition characteristic can be provided.

In the present invention, the third plating step may include steps of: forming a mask pattern having openings in forming positions of the first and second bump electrodes; and selectively growing by plating exposed portions of the underlying conductors exposed from the openings. As a result, bump electrodes of arbitrary shape can be easily formed on the surfaces of the lead conductor and the dummy lead conductor.

A surface-mounting type coil component according to yet another aspect of the present invention includes: a substrate; first and second spiral conductors that are formed on one and the other of main surfaces of the substrate, respectively; a first terminal electrode that is formed on the one main surface and connected to an outer peripheral end of the first spiral conductor; a second terminal electrode that is formed on the other main surface and connected to an outer peripheral end of the second spiral conductor; a first through-hole conductor that penetrates the substrate to connect inner peripheral ends of the first and second spiral conductors each other; a first dummy terminal electrode that is formed on the one main surface and vertically overlapped with the second terminal electrode; a second dummy terminal electrode that is formed on the other main surface and vertically overlapped with the first terminal electrode; a second through-hole conductor that penetrates the substrate to connect the first dummy terminal electrode with the second terminal electrode; a first metal magnetic powder-containing resin layer that is formed on the one main surface and covers the first spiral conductor, the first terminal electrode, and the first dummy terminal electrode; a second metal magnetic powder-containing resin layer that is formed on the other main surface and covers the second spiral conductor, the second terminal electrode, and the second dummy terminal electrode; a first lead electrode that penetrates the first metal magnetic powder-containing resin layer and is connected to a top surface of the first terminal electrode; and a second lead electrode that penetrates the first metal magnetic powder-containing resin layer and is connected to a top surface of the first dummy terminal electrode, wherein outer side surfaces of the first and second terminal electrodes, the first and second dummy terminal electrodes, and the first and second lead electrodes are each exposed without being covered with the first and second metal magnetic powder-containing resin layers, and side surfaces of the substrate lying on the same planes as the outer side surfaces of the first and second terminal electrodes are exposed without being covered with the first and second metal magnetic powder-containing resin layers.

According to the present invention, the provision of the first and second dummy terminal electrodes along with the first and second spiral conductors can prevent thickening of the outermost turns of the first and second spiral conductors, respectively. The outer side surface of the first terminal electrode and the outer side surface of the first dummy terminal electrode are exposed at the side surfaces of the coil component. At the time of surface mounting, solder fillets can thus be formed to increase the mounting strength of the solder connection. The exposed surfaces of the substrate function as stopper surfaces for suppressing the formation of solder fillets. This can prevent the solder fillets from being formed up to the exposed surface of the second dummy terminal electrode exposed along with the first terminal electrode and the exposed surface of the second terminal electrode exposed along with the first dummy terminal electrode. The solder fillets can thus be formed with a minimum amount of solder, which can reduce the material cost. Such a configuration can also prevent solder melted or re-melted in a reflow step from creeping up the side electrodes to reach a shield cover covering an upper part of the coil component, if any, and cause an electrical connection failure.

In the present invention, the substrate may include first and second side surfaces that are parallel to each other, and third and fourth side surfaces that are orthogonal to the first and second side surfaces. The first side surface of the substrate may form the same plane as the outer side surface of the first terminal electrode and the outer side surface of the second dummy terminal electrode. The second side surface of the substrate may form the same plane as the outer side surface of the second terminal electrode and the outer side surface of the first dummy terminal electrode. According to such a configuration, a solder fillet can be formed on each of the plurality of side electrodes at the time of surface mounting, whereby the mounting strength of the solder connection can be improved. The solder fillets can also be formed with a minimum amount of solder, which can reduce the material cost.

The coil component according to the present invention may further include a through-hole magnetic body that penetrates a corner portion of the substrate to connect the first metal magnetic powder-containing resin layer with the second metal magnetic powder-containing resin layer. The first and second sides of the substrate may be arranged in areas excluding the forming area of the through-hole conductor. According to such a configuration, the solder fillets can be formed with an even smaller amount of solder. In addition, a coil component having high inductance can be provided.

The coil component according to the present invention may further include first and second external electrodes that are formed on a main surface of the first metal magnetic powder-containing resin layer and connected to the first and second lead electrodes, respectively. The first external electrodes may constitute a first L-shaped electrode with the first lead electrode, the first terminal electrode, and the first dummy terminal electrode. The second external electrode may constitute a second L-shaped electrode with the second lead electrode, the second terminal electrode, and the second dummy terminal electrode. Such a configuration can increase the electrode areas to further increase the mounting strength of the solder connection.

According to the present invention, the dummy lead conductor formed between the outermost turn of the planar spiral conductor and the end of the substrate can suppress the lateral growth of the plating layer constituting the outermost turn of the planar spiral conductor in the electrolytic plating step. In addition, external electrodes having electrode surfaces only at the bottom of the coil component can be employed. This can provide external electrodes of a desired area without reducing the coil forming area and the magnetic body forming areas. According to the present invention, it is also possible to provide a coil component that prevents the outermost turn of the planar spiral conductor from being largely deformed in shape, and that can suppress the height of solder fillets and provide a desired mounting strength with a small amount of solder at the time of surface mounting.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be described hereinafter in detail with reference to the accompanying drawings.

Figure 1:
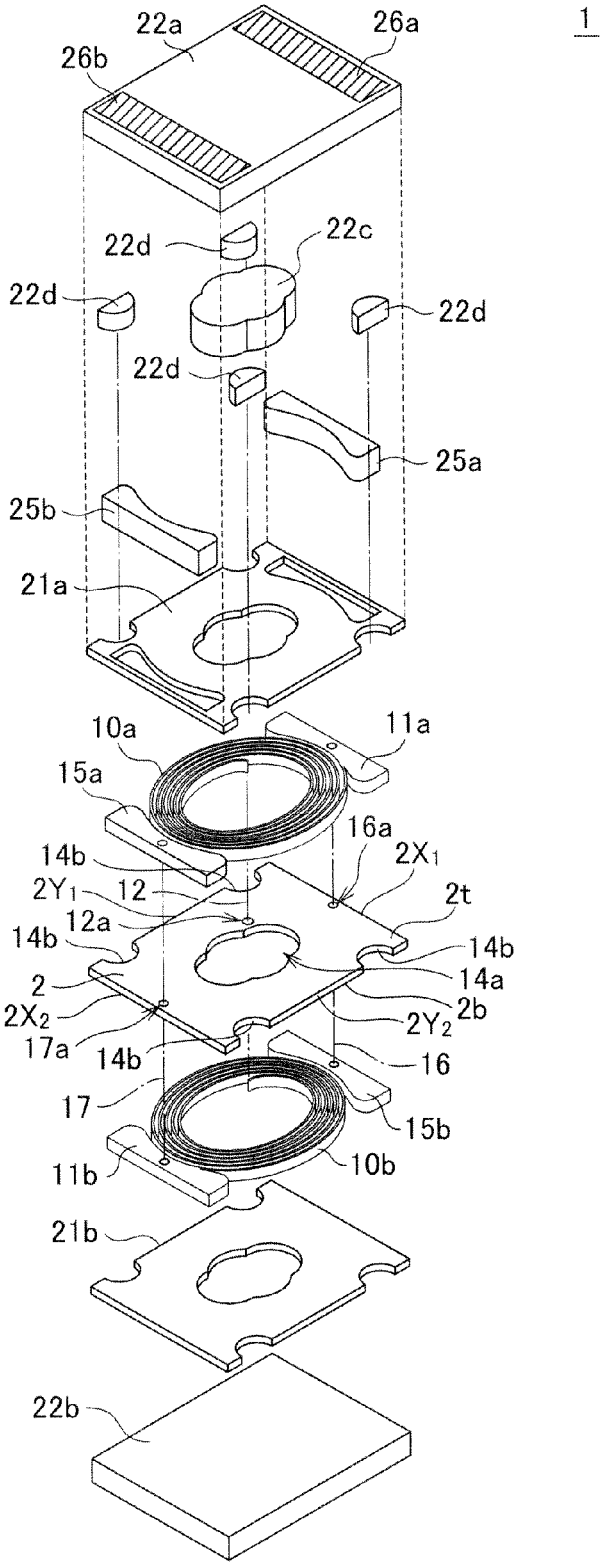
FIG. 1 is an exploded perspective view of a coil component according to a first embodiment of the present invention.

FIG. 1 is an exploded perspective view of a coil component 1 according to a first embodiment of the present invention. As shown in the diagram, the coil component 1 includes a substrate 2 of generally rectangular shape. The "generally rectangular shape" shall include not only a perfect rectangle but also a rectangular shape partly notched in corners. As employed herein, the term "corner portions" of a rectangular shape that is partly notched in corners refers to the corner portions of a perfect rectangle that would be obtained without the notches.

The substrate 2 is preferably made of a typical printed-circuit board which is obtained by impregnating a glass cloth with epoxy resin. For example, a BT resin substrate, an FR4 substrate, or an FR5 substrate may be used.

A planar spiral conductor 10*a* (first planar spiral conductor) is formed on a center portion of a top surface 2*t* of the substrate 2. A planar spiral conductor 10*b* (second planar spiral conductor) is similarly formed on a center portion of a bottom surface 2*b*. The substrate 2 has a conductor-embedding through-hole 12*a* (first through-hole), in which a through-hole conductor 12 (first through-hole conductor) is embedded. An inner peripheral end of the planar spiral conductor 10*a* and an inner peripheral end of the planar spiral conductor 10*b* are connected to each other by the through-hole conductor 12.

The planar spiral conductors 10*a* and 10*b* preferably have an elliptical spiral shape. An elliptical spiral can be used to maximize a loop size according to the rectangular shape of the substrate. As will be described in detail later, if through-hole magnetic bodies 22*d* are formed in four corners of the substrate 2 closer to the center in a width direction than the corner portions, the elliptical spiral is easier to secure a forming area than an oblong circular spiral.

The planar spiral conductor 10*a* and the planar spiral conductor 10*b* are wound in opposite directions. More specifically, the planar spiral conductor 10*a* seen from the top surface 2*t* side is wound counterclockwise from an inner peripheral end to an outer peripheral end. The planar spiral conductor 10*b* seen from the top surface 2*t* side is wound clockwise from an inner peripheral end to an outer peripheral end. With such a winding method, when a current is passed between the outer peripheral end of the planar spiral conductor 10*a* and the outer peripheral end of the planar spiral conductor 10*b*, both the planar spiral conductors generate magnetic fields in the same direction to reinforce each other. The coil component 1 thus functions as a single inductor.

Lead conductors 11*a* and 11*b* are formed on the top surface 2*t* and the bottom surface 2*b* of the substrate 2, respectively. The lead conductor 11*a* (first lead conductor) is formed along a side surface $2X_1$ of the substrate 2. The lead conductor 11*b* (second lead conductor) is formed along a side surface $2X_2$ opposed to the side surface $2X_1$. The lead conductor 11*a* is connected to the outer peripheral end of the planar spiral conductor 10*a*. The lead conductor 11*b* is connected to the outer peripheral end of the planar spiral conductor 10*b*.

A dummy lead conductor 15*a* (first dummy lead conductor) is formed on the top surface 2*t* of the substrate 2 in an area between an outermost turn of the planar spiral conductor 10*a* and an end of the substrate 2. More specifically, the dummy lead conductor 15*a* has generally the same planar shape as that of the lead conductor 11*b*, and is overlapped with the lead conductor 11*b* when seen in a plan view. In other words, the dummy lead conductor 15*a* is formed between the side surface $2X_2$ of the substrate 2 and the outermost turn of the planar spiral conductor 10*a*. The dummy lead conductor 15*a* is free from an electrical connection with other conductors within the same plane, but is connected to the lead conductor 11*b* via a through-hole conductor 17 (second through-hole conductor) penetrating the substrate 2. The substrate 2 has a conductor-embedding through-hole 17*a*, in which the through-hole conductor 17 is embedded.

Similarly, a dummy lead conductor 15*b* (second dummy lead conductor) is formed on the bottom surface 2*b* of the substrate 2 in an area between an outermost turn of the planar spiral conductor 10*b* and an end of the substrate 2. More specifically, the dummy lead conductor 15*b* has the same planar shape as that of the lead conductor 11*a*, and is overlapped with the lead conductor 11*a* when seen in a plan view. In other words, the dummy lead conductor 15*b* is formed between the side surface $2X_1$ of the substrate 2 and the outermost turn of the planar spiral conductor 10*b*. Like the dummy lead conductor 15*a*, the dummy lead conductor 15*b* is free from an electrical connection with other conductors with the same plane, but is connected to the lead conductor 11*a* via a through-hole conductor 16 (third through-hole conductor) penetrating the substrate 2. The substrate 2 has a conductor-embedding through-hole 16*a*, in which the through-hole conductor 16 is embedded.

A side surface of the dummy lead conductor 15*a* opposed to the outermost turn of the planar spiral conductor 10*a* is curved to the shape of the outermost turn of the planar spiral conductor 10*a*. A side surface of the dummy lead conductor 15*b* opposed to the outermost turn of the planar spiral conductor 10*b* is similarly curved along the outermost turn of the planar spiral conductor 10*b*. If the side surfaces of the dummy lead conductors 15*a* and 15*b* are formed in such a curved shape, the lateral growth of plating layers constituting the planar spiral conductors 10*a* and 10*b* to be described later can be reliably suppressed. This allows the formation of a high-precision pattern. The space width between the planar spiral conductors and the dummy lead conductors is preferably set to be approximately equal to the pitch width of the planar spiral conductors. Such a setting can make the line width of the outermost turns the same as the width of the inner lines, which allows more precise characteristic control.

The foregoing planar spiral conductors 10*a* and 10*b*, lead conductors 11*a* and 11*b*, and dummy lead conductors 15*a* and 15*b* are each formed by forming a base layer by an electroless plating step, followed by two electrolytic plating steps. Cu may be suitably used as the material of the base layer and the material of the plating layers formed by the two electrolytic plating steps. The second electrolytic plating step is the foregoing HAP step. The manufacturing steps will be described in detail later. In the HAP step, as described above, plating layers can laterally grow large where there is no other adjoining seed layer. In contrast, in the present embodiment, the provision of the dummy lead conductors 15*a* and 15 prevents the outermost turns of the planar spiral conductors 10*a* and 10*b* from becoming extremely thick. A desired wiring shape can thus be maintained.

The planar spiral conductor 10*a*, the lead conductor 11*a*, and the dummy lead conductor 15*a* formed on the top surface 2*t* side of the substrate 2 are covered with an insulating resin layer 21*a*. The insulating resin layer 21*a* is arranged to prevent electrical conduction between the conductors and a metal magnetic powder-containing resin layer 22*a*. Similarly, the planar spiral conductor 10*b*, the lead conductor 11*b*, and the dummy lead conductor 15*b* formed on the bottom surface 2*b* side of the substrate 2 are covered with an insulating resin layer 21*b*. The insulating resin layer 21*b* is arranged to prevent electrical conduction between the conductors and a metal magnetic powder-containing resin layer 22*b*.

The top surface 2*t* and the bottom surface 2*b* of the substrate are further covered with the metal magnetic powder-containing resin layers 22*a* and 22*b* from above the insulating resin layers 21*a* and 21*b*, respectively. The metal magnetic powder-containing resin layers 22*a* and 22*b* are made of a magnetic material (metal magnetic powder-containing resin) formed by mixing metal magnetic powder with resin. Permalloy-based materials are suitably used as the metal magnetic powder. A specific example is metal magnetic powder that contains a Pb—Ni—Co alloy having an average particle size of 20 to 50 μm and carbonyl iron having an average particle size of 3 to 10 μm, mixed in a predetermined ratio such as a weight ratio of 70:30 to 80:20, preferably 75:25. The metal magnetic powder-containing resin layers 22*a* and 22*b* may have a metal magnetic powder content of 90% to 97% by weight.

Liquid or powder epoxy resin is preferably used as the resin. The metal magnetic powder-containing resin layers 22*a* and 22*b* preferably have a resin content of 3% to 10% by weight . The resin functions as an insulating binder. The metal magnetic powder-containing resin layers 22*a* and 22*b* having such a configuration have the characteristic that the saturation flux density decreases with the decreasing amount of metal magnetic powder with respect to the resin, and the saturation flux density increases with the increasing amount of metal magnetic powder.

In the present embodiment, the metal magnetic powder-containing resin preferably contains three types of metal powders with different average particle sizes. The use of such metal powders can reduce core loss while maintaining the permeability of the metal magnetic powder-containing resin layers.

The permeability of a metal magnetic powder-containing resin depends mainly on the particle size and the packing density (bulk density) of metal powder. As the particle size of the metal powder is increased to increase the permeability, gaps between the metal particles become greater. It is therefore effective to add metal powder having a smaller particle size to fill the gaps between the metal particles. However, as the metal powders are packed more closely, the distances between the metal particles can be so small that the core loss increases. Medium-sized powder having an intermediate size between the large-sized powder and small-sized powder can be added to reduce the core loss without lowering the permeability. As compared to the combination of the large-sized and small-sized powders, the addition of the medium-sized powder seems to somewhat lower the packing density of the metal powders, whereas the greater particle sizes can maintain the permeability.

The large-sized metal powder is preferably a permalloy-based material having an average particle size of 15 to 100 μm, preferably 25 to 70 μm, more preferably 28 to 32 μm. The medium-sized powder is preferably carbonyl iron having an average particle size of 4 μm. The small-sized metal powder is preferably carbonyl iron having an average particle size of 1 μm. An example of the preferable weight ratio of the epoxy resin, the large-sized powder, the medium-sized powder, and the small-sized powder is 74.5:12.15:12.15:3.0. The particle size distribution of the metal powders in such a metal magnetic powder-containing resin has three clear peaks at the positions of the average particle sizes of the large-sized powder, medium-sized powder, and small-sized powder.

As shown in FIG. 1, the substrate 2 has a through-hole 14*a* and four through-holes 14*b*. The through-hole 14*a* penetrates the substrate 2 in a center portion (hollow portion) surrounded by the planar spiral conductors 10*a* and 10*b*. The fourth through-holes 14*b* penetrate the substrate 2 outside the planar spiral conductors 10*a* and 10*b*. The four through-holes 14*b* are semicircular openings formed in side surfaces $2Y_1$ and $2Y_2$ of the substrate 2. The through-holes 14*b* are arranged corresponding to the respective four corners of the substrate 2. The metal magnetic powder-containing resin is also embedded in the magnetic path-forming through-holes 14*a* and 14*b*. As shown in FIG. 1, the embedded metal magnetic powder-containing resin constitutes through-hole magnetic bodies 22*c* and 22*d*. The through-hole magnetic bodies 22*c* and 22*d* are intended to form a completely-closed magnetic circuit in the coil component 1.

Although not shown in FIG. 1, a thin insulating layer is formed on the surfaces of the metal magnetic powder-containing resin layers 22*a* and 22*b*. Such an insulating layer can be formed by treating the surfaces of the metal magnetic powder-containing resin layers 22*a* and 22*b* with phosphate. The provision of the insulating layer prevents electrical conduction between an external electrode 26*a* and the metal magnetic powder-containing resin layers 22*a*.

The coil component 1 according to the present embodiment includes a bump electrode 25*a* (first bump electrode) formed on the top surface of the lead conductor 11*a*, and a bump electrode 25*b* (second bump electrode) formed on the top surface of the dummy lead conductor 15*a*. The bump electrodes 25*a* and 25*b* are formed by forming a resist pattern that exposes only the top surface of the lead conductor 11*a* and the top surface of the dummy lead conductor 15*a*, and further performing electrolytic plating with the conductors as seed layers. The step of forming the insulating resin layers 21*a* and 21*b* and the step of forming the metal magnetic powder-containing resin layers 22*a* and 22*b* are performed after the formation of the bump electrodes 25*a* and 25*b*.

The bump electrodes 25*a* and 25*b* have a planar shape equivalent to or somewhat smaller than the shape of the lead conductor and the dummy lead conductor. The bump electrodes 25*a* and 25*b* are preferably extended in the longitudinal direction of the lead conductor and the dummy lead conductor. Such a configuration can improve the formation yield of the bump electrodes and reduce the time of the plating growth. Unlike ones formed by thermally compressing metal balls of Cu, Au, or the like by using a flip chip bonder, "bump electrodes" as employed herein refer to thick-film plating electrodes formed by plating processing. The bump electrodes may have a thickness equivalent to or greater than that of the metal magnetic powder-containing resin layer, e.g., 0.1 to 0.4 mm or so. The bump electrodes thus have a thickness greater than that of the conductor patterns such as the planar spiral conductors. In particular, the bump electrodes have a thickness more than five times that of the planar spiral conductors.

A pair of external electrodes 26*a* and 26*b* (first and second external electrodes) are formed on the bottom surface of the coil component 1, which is the main surface of the metal magnetic powder-containing resin layer 22*a*. Note that FIG. 1 shows the coil component 1 with the bottom surface (mounting surface) upward. The external electrodes 26*a* and 26*b* are connected to the lead conductors 11*a* and 11*b* through the foregoing bump electrodes 25*a* and 25*b*, respectively. The external electrodes 26*a* and 26*b* are mounted on lands formed on a not-shown mounting substrate by soldering. As a result, a current can be passed between the outer peripheral end of the planar spiral conductor 10*a* and the outer peripheral end of the planar spiral conductor 10*b* through wiring formed on the mounting substrate.

The external electrodes 26*a* and 26*b* are rectangular traces having an area greater than that of the bump electrodes 25*a* and 25*b*. The reason is as follows: To increase the inductance of a coil, the forming area of the coil needs to be maximized. To design a coil forming area as large as possible within given dimensions, lead conductors and dummy lead conductors arranged outside the coil are preferably minimized. Suppose that bump electrodes are formed by using the lead conductors and the dummy lead conductors and the exposed surfaces of the bump electrodes are used as external electrodes. In such a case, if the lead conductors and the dummy lead conductors are reduced in area, the bump electrodes formed thereon also become smaller in area and fail to ensure a mounting strength. In view of this, in the present embodiment, the external electrodes (sputter electrodes) having an area greater than that of the bump electrodes are formed to ensure a mounting strength.

In the present embodiment, the external electrodes 26*a* and 26*b* are selectively formed on the main surface of the metal magnetic powder-containing resin layer 22*a*. In other words, the external electrodes 26*a* and 26*b* are formed only on the bottom surface of the coil component 1, not on the side surfaces or the top surface. If external electrodes are also formed on the side surfaces of the coil component 1, solder fillets can be formed at the time of surface mounting. The solder fillets allow a visual examination of the mounting state of the chip for reliable mounting, whereas the coil component needs an additional mounting margin as much as the solder fillets. If external electrodes are formed on the top surface of the coil component, there arises a problem of a contact between the external electrodes of the coil component and a metal cover, if any, that covers the mounting substrate from above. Since the external electrodes 26*a* and 26*b* are formed only on the bottom surface of the coil component 1, it is possible to avoid the foregoing problems and achieve high-density mounting by the omission of solder fillets.

Next, the role of the dummy lead conductors 15*a* and 15*b* will be described in more detail in conjunction with mass-production steps of the coil component 1.

Figure 2A:
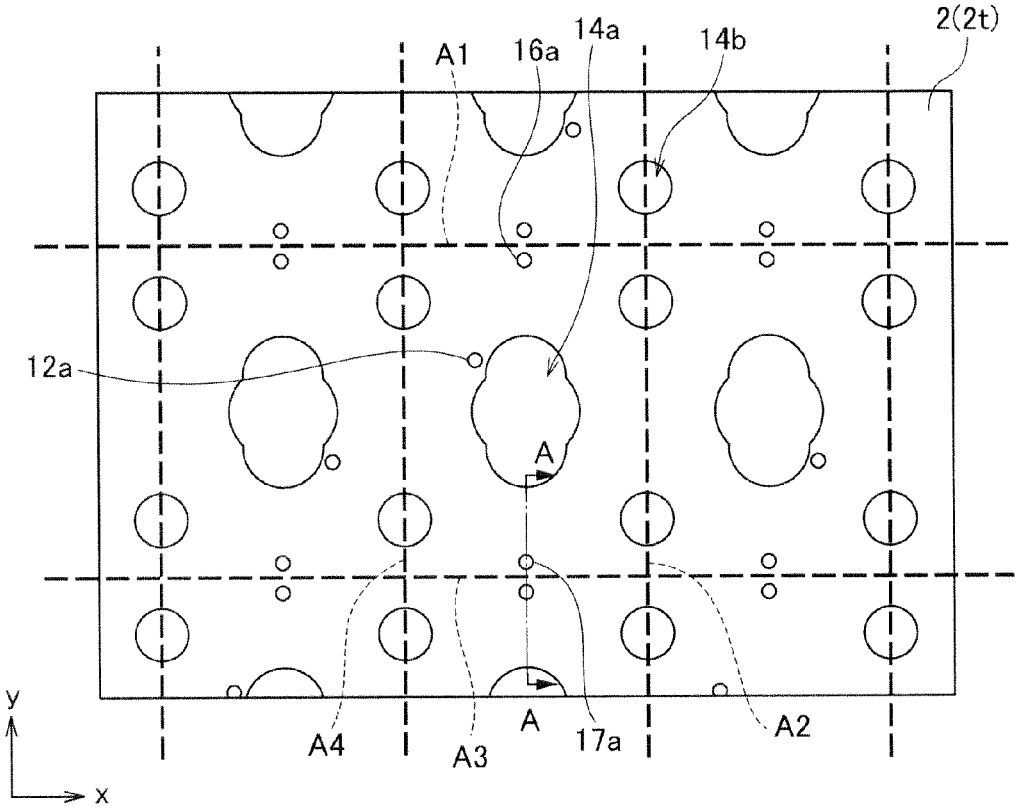
FIG. 2A is a diagram showing the coil component in the process of the mass-production steps of the coil component according to the first embodiment of the present invention and is a plan view of an uncut substrate seen from the top surface side.
Figure 10:
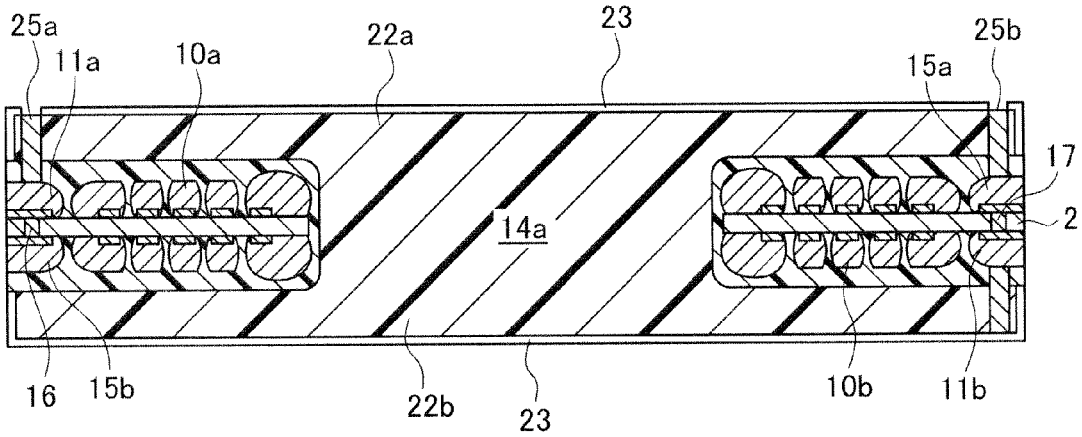
FIG. 10 is a diagram showing the separated coil component after the dicing step in the process of the mass-production steps of the coil component according to the first embodiment of the present invention.
Figure 11:
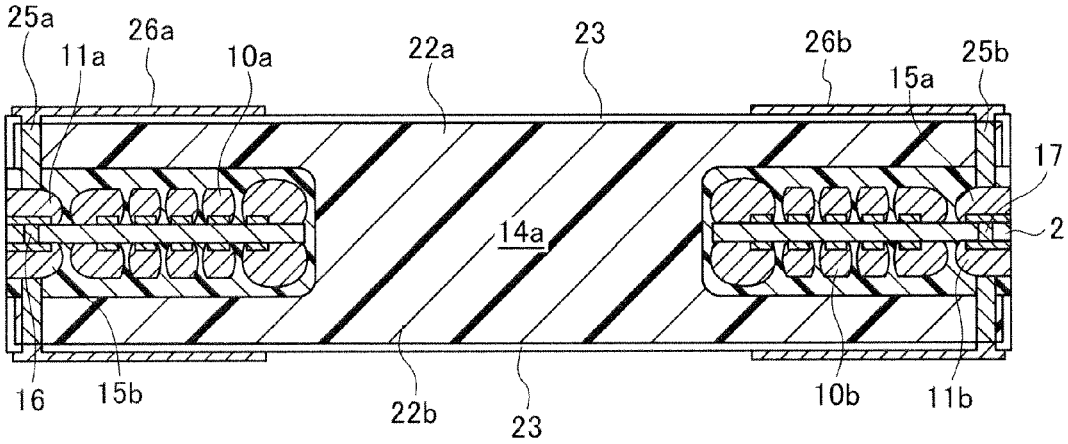
FIG. 11 is a diagram showing the separated coil component after the dicing step in the process of the mass-production steps of the coil component according to the first embodiment of the present invention.

FIGS. 2A and 2B to 4A and 4B, 6A and 6B to 9A and 9B, 10, and 11 are diagrams showing the coil component 1 in the process of the mass-production steps of the coil component 1. FIGS. 2A, 3A, 4A, 6A, 7A, 8A, and 9A are plan views of an uncut substrate 2 seen from the top surface 2*t* side. FIGS. 2B, 3B, 4B, 6B, 7B, 8B, and 9B are cross-sectional views taken along the line A-A in the respective corresponding plan views. Broken lines in FIGS. 2A, 3A, 4A, 6A, 7A, 8A, and 9A represent cutting lines in a dicing step. Each individual rectangular area surrounded by the cutting lines (hereinafter, simply referred to as a "rectangular area") constitutes a coil component 1. The following description focuses on the rectangular area at the center of FIG. 2A. As shown in FIG. 2A, the four sides of the rectangular area will be referred to as sides A1 to A4 clockwise. FIGS. 10 and 11 are cross-sectional views of the separated coil component 1 after the dicing step. The cross sections shown in FIGS. 10 and 11 correspond to the line B-B of FIG. 9A.

Figure 2B:
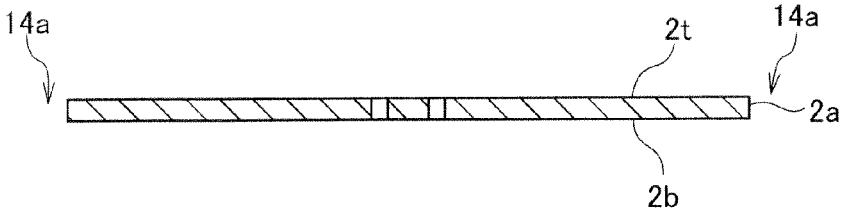
FIG. 2B is a cross-sectional view taken along the line A-A in FIG. 2A.

Initially, as shown in FIGS. 2A and 2B, conductor-embedding through-holes 12*a*, 16*a*, and 17*a* and magnetic path-forming through-holes 14*a* and 14*b* are formed in the substrate 2. The through-holes 12*a*, 14*a*, 16*a*, and 17*a* are singly formed in each rectangular area. With respect to the pattern shape of the rectangular area at the center, the rectangular areas on the top, bottom, left, and right have a doubly-symmetrical pattern shape. The through-holes are therefore formed in different positions.

The through-holes 14*b* each have a circular pattern, and are arranged on the cutting lines A2 and A4 extending in a y direction. The through-holes 14*b* are common to coil components on both sides of the cutting lines. Each rectangular area is associated with four through-holes 14*b*. When the substrate 2 is cut by the cutting lines, semicircular notches are obtained. The semicircular notches are formed in the two longitudinal side surfaces $2Y_1$ and $2Y_2$ (third and fourth sides).

The forming positions of the through-holes 14*b* are not in the exact corner portions of the rectangular area of the substrate 2, but on the cutting lines A2 and A4 (side surfaces $2Y_1$ and $2Y_2$) in the y direction somewhat closer to the center than the corner portions. The reason is that the areas along the side surfaces $2X_1$ and $2X_2$ of the substrate 2 are used as forming areas of the lead conductors 11*a* and 11*b* and the dummy lead conductors 15*a* and 15*b*. As will be described later, the lead conductors 11*a* and 11*b* and the dummy lead conductors 15*a* and 15*b* can thus be extended from end to end in the direction of the side surfaces $2X_1$ and $2X_2$ without being interfered with the through-holes 14*b*. In other words, the lead conductors (or lead conductors and dummy lead conductors) in the rectangular areas adjoining in an x direction can be connected to each other before the dicing of the substrate 2. Such a connected structure of the lead conductors and dummy lead conductors is intended to pass a plating current in the x direction as well as in the y direction in an HAP step to be described later.

Figure 3A:
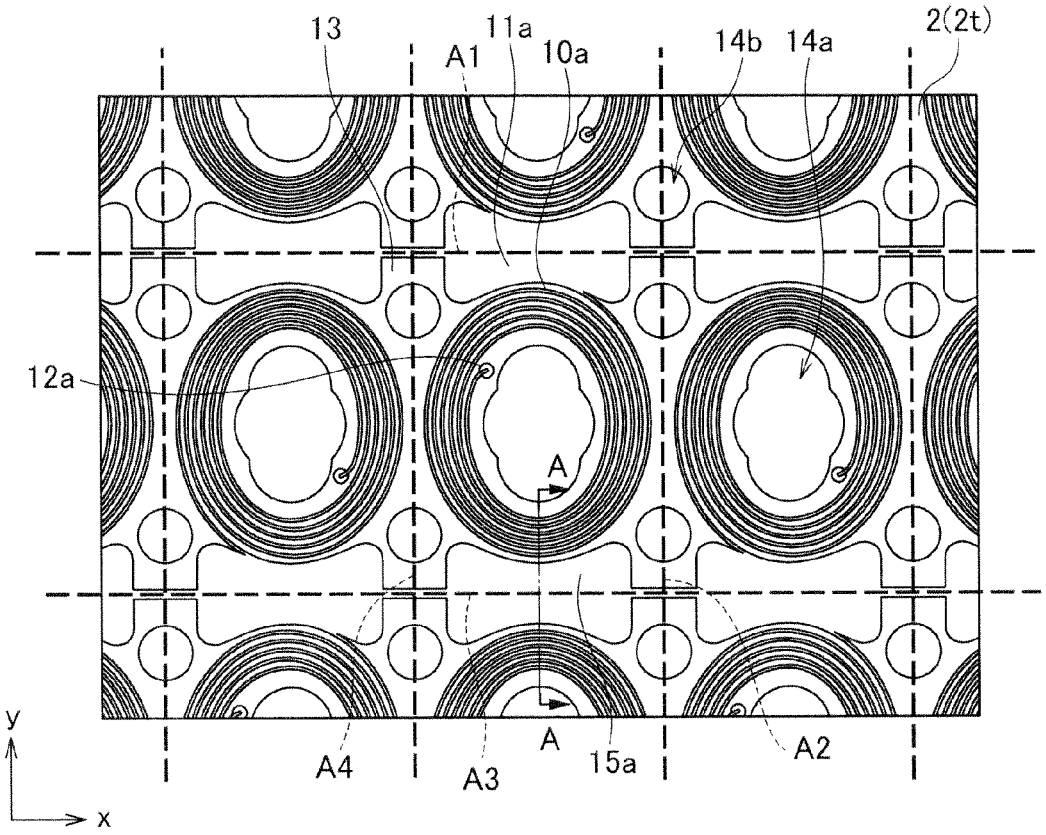
FIG. 3A is a diagram showing the coil component in the process of the mass-production steps of the coil component according to the first embodiment of the present invention and is a plan view of an uncut substrate seen from the top surface side.
Figure 3B:
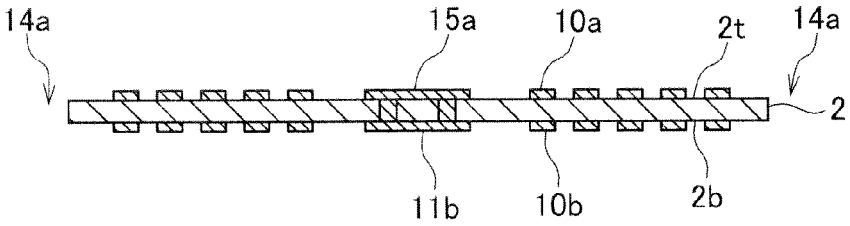
FIG. 3B is a cross-sectional view taken along the line A-A in FIG. 3A.

Next, as shown in FIGS. 3A and 3B, the planar spiral conductor 10*a* is formed in each rectangular area on the top surface 2*t* of the substrate 2 so that its inner peripheral end covers the through-hole 12*a*. The lead conductor 11*a* is formed along the side Al (first side) of the rectangular area. The dummy lead conductor 15*a* is formed along the side A3 (second side). The lead conductor 11*a* is common to another rectangular area adjoining across the side A1. The lead conductor 11*a* is formed in connection with the outer peripheral ends of the planar spiral conductors 10*a* formed in both rectangular areas. The dummy lead conductor 15*a* is common to another rectangular area adjoining across the side A3. The dummy lead conductor 15*a* is connected to neither of the planar spiral conductors 10*a* formed in the rectangular areas.

The planar spiral conductor 10*b* is similarly formed in each rectangular area on the bottom surface 2*b* of the substrate 2 so that its inner peripheral end covers the through-hole 12*a*. The lead conductor 11*b* is formed along the side A3 of the rectangular area. The dummy lead conductor 15*b* is formed along the side A1 (not shown in FIGS. 3A and 3B). The lead conductor 11*b* is common to another rectangular area adjoining across the side A3. The lead conductor 11*b* is formed in connection with the outer peripheral ends of the planar spiral conductors 10*b* formed in both rectangular areas. The dummy lead conductor 15*b* is common to another rectangular area adjoining across the side A1. The dummy lead conductor 15*b* is connected to neither of the planar spiral conductors 10*b* formed in the rectangular areas.

A specific method for forming the planar spiral conductors 10*a* and 10*b* and the like in the phase of FIGS. 3A and 3B will be described below. Initially, a Cu base layer is formed on both surfaces of the substrate 2 by electroless plating. Photoresist layers are formed on the surfaces of the base layers. Note that the base layers are also formed in the through-holes 12*a*, whereby the through-hole conductors 12 are formed. The photoresist layers can be formed, for example, by pasting a sheet resist. Next, opening patterns (negative patterns) shaped to the planar spiral conductors 10*a* and 10*b*, the lead conductors 11*a* and 11*b*, and the dummy lead conductors 15*a* and 15*b* are formed in the photoresist layers by photolithography each side. A plating layer is formed in the opening patterns by electrolytic plating. After the removal of the photoresist layers, portions of the base layers other than where the plating layers are formed are removed by etching. The electrolytic plating step corresponds to a first electrolytic plating step (first plating step). Since the base layers are unpatterned planar conductors, the problem with the flowing direction of the plating current will not occur. The steps so far complete the planar spiral conductors 10*a* and 10*b*, the lead conductors 11*a* and 11*b*, and the dummy lead conductors 15*a* and 15*b*, each of which includes a base layer and a plating layer.

The conductors formed on the top surface 2*t* and the bottom surface 2*b* of the substrate 2 by the foregoing steps serve as seed layers in an HAP step (second plating step) to be described later. The seed layers are continuous both in the x direction and the y direction through the lead conductors 11*a* and 11*b*, the dummy lead conductors 15*a* and 15*b*, and the through-hole conductors 12. In the HAP step, the plating current can thus be passed both in the x direction and the y direction.

Figure 4A:
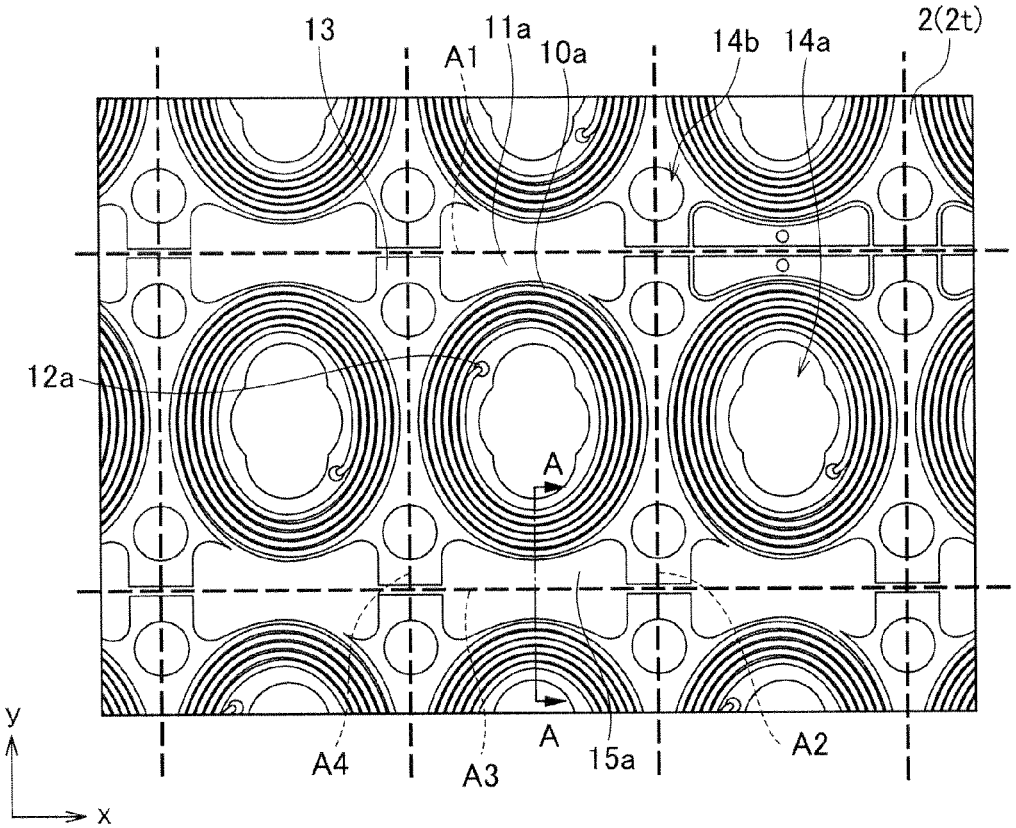
FIG. 4A is a diagram showing the coil component in the process of the mass-production steps of the coil component according to the first embodiment of the present invention and is a plan view of an uncut substrate seen from the top surface side.
Figure 4B:
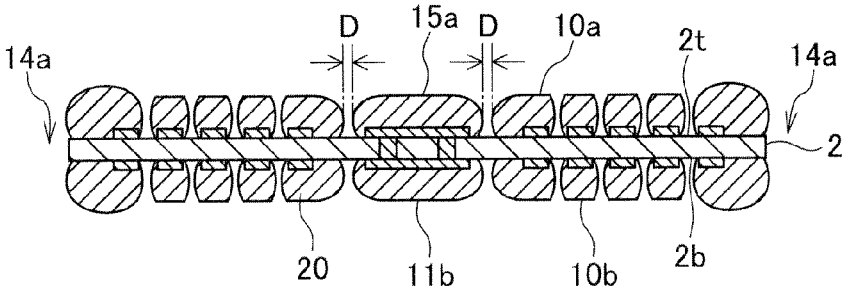
FIG. 4B is a cross-sectional view taken along the line A-A in FIG. 4A.

Next, as shown in FIGS. 4A and 4B, HAP processing is performed. Specifically, the substrate 2 is immersed into a plating solution while a considerably high plating current of approximately 0.05 to 0.3 $A/mm^2$ is passed through the foregoing conductors serving as seed layers from the ends of the uncut substrate 2. Since the seed layers are continuous both in the x direction and the y direction as described above, the plating current flows both in the x direction and the y direction. As a result, metal ions are uniformly electrodeposited on the planar spiral conductors 10*a* and 10*b* and the like to form plating layers 20 of uniform thickness.

As shown in FIG. 4B, the formation of the plating layers can significantly increase the thicknesses of the conductors. The reason for the provision of such large thicknesses is that the coil component 1 according to the present embodiment is a power supply inductor and an extremely low direct-current resistance is needed.

Figure 5:
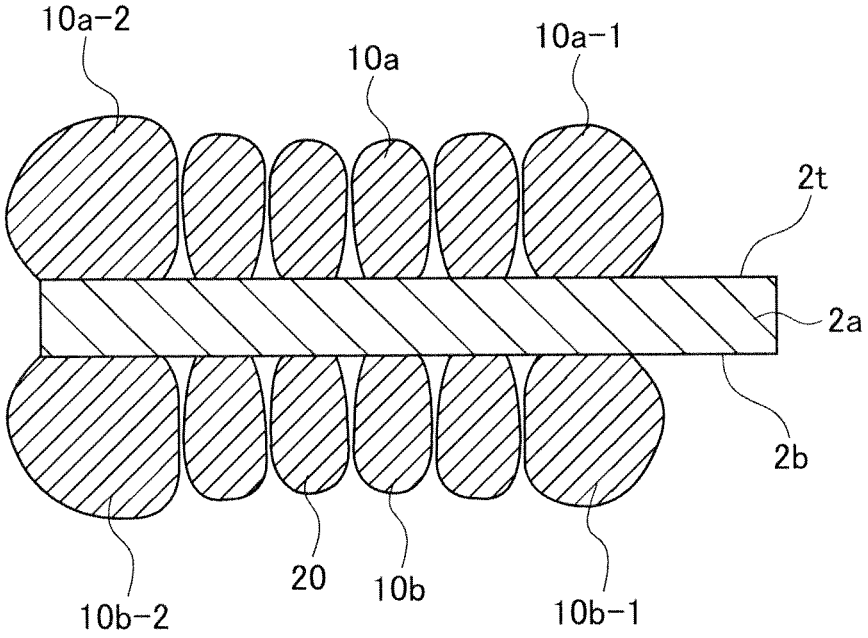
FIG. 5 is a trace of a cross-sectional electron micrograph of the planar spiral conductors 10*a* and 10*b* that were actually formed by the HAP processing.

As described above, the HAP processing also laterally grows the plating layers 20 large in locations where there is no other adjoining seed layer. FIG. 5 is a trace of a cross-sectional electron micrograph of the planar spiral conductors 10*a* and 10*b* that were actually formed by the HAP processing. FIG. 5 shows a case where the planar spiral conductors 10*a* and 10*b* were formed alone (without the other conductors including the dummy lead conductors 15*a* and 15*b*). As shown in FIG. 5, the innermost turn 10*a*-1 and the outermost turn 10*a*-2 of the planar spiral conductor 10*a* and the innermost turn 10*b*-1 and the outermost turn 10*b*-2 of the planar spiral conductor 10*b* all bulge out laterally as compared to the other portions. The bulging results from the large lateral growth of the plating layers 20.

In the present embodiment, for example, the dummy lead conductor 15*a* is arranged on the top surface 2*t*. As shown in FIG. 4B, gaps having a distance D are thereby formed between the outermost turns of the planar spiral conductors 10*a* and the dummy lead conductor 15*a*. The gaps are a result of the interference of the lateral growth of the plating layer 20 constituting the outermost turns of the planar spiral conductors 10*a* with the plating layer 20 constituting the dummy lead conductor 15*a*. The same applies to bottom surface 2*b*. According to the present embodiment, the lateral growth of the plating layer 20 growing on the outermost turns of the planar spiral conductors 10*a* and 10*b* is thus suppressed by the dummy lead conductors 15*a* and 15*b*. This can prevent the outermost turns of the planar spiral conductors 10*a* and 10*b* from becoming extremely thick.

Figure 6A:
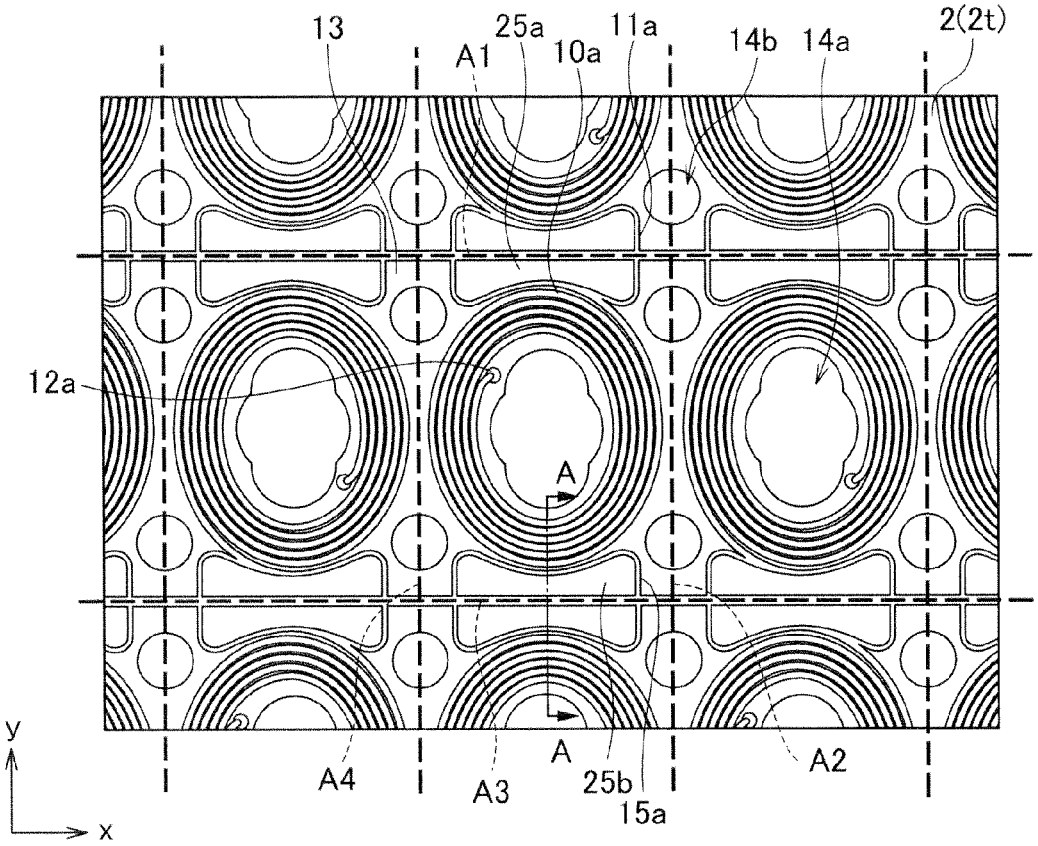
FIG. 6A is a diagram showing the coil component in the process of the mass-production steps of the coil component according to the first embodiment of the present invention and is a plan view of an uncut substrate seen from the top surface side.
Figure 6B:
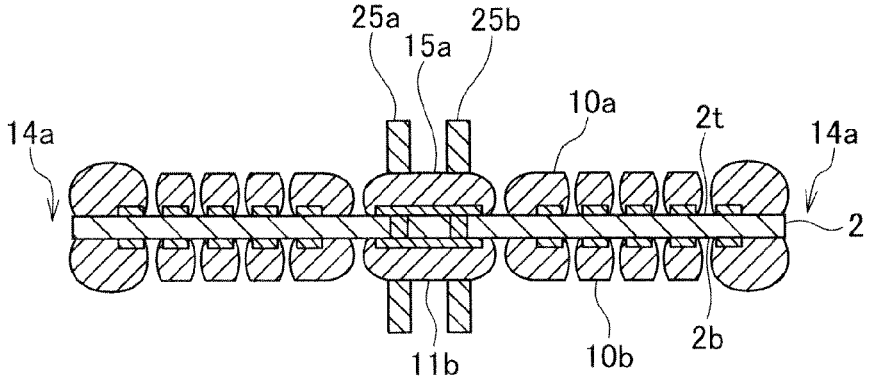
FIG. 6B is a cross-sectional view taken along the line A-A in FIG. 6A.

Next, as shown in FIGS. 6A and 6B, the top surfaces of the lead conductors 11*a* and 11*b* and the dummy lead conductors 15*a* and 15*b* are selectively grown by plating to form the bump electrodes 25*a* and 25*b*. To form the bump electrodes 25*a* and 25*b*, a photoresist layer is formed on the entire surface of the substrate. Opening patterns (negative patterns) are formed in the photoresist layer at the forming positions of the bump electrodes 25*a* and 25*b* by photolithography. A plating layer is then formed in the opening patterns by a third electrolytic plating step (third plating step), and the photoresist layer is removed. By such steps, the bump electrodes 25*a* and 25*b* made of the plating layer are formed. The bump electrodes 25*a* and 25*b* need to be grown by plating to be higher than the metal magnetic powder-containing resin layer 22*a* to be described later.

Figure 7A:
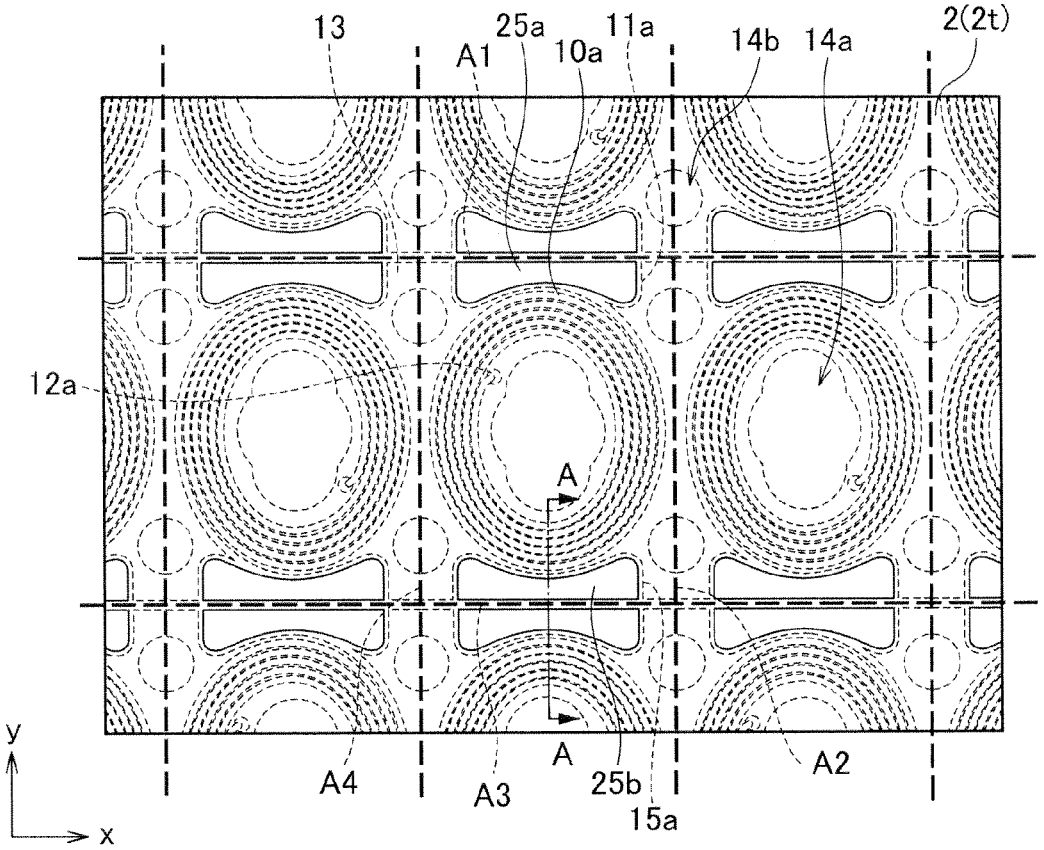
FIG. 7A is a diagram showing the coil component in the process of the mass-production steps of the coil component according to the first embodiment of the present invention and is a plan view of an uncut substrate seen from the top surface side.
Figure 7B:
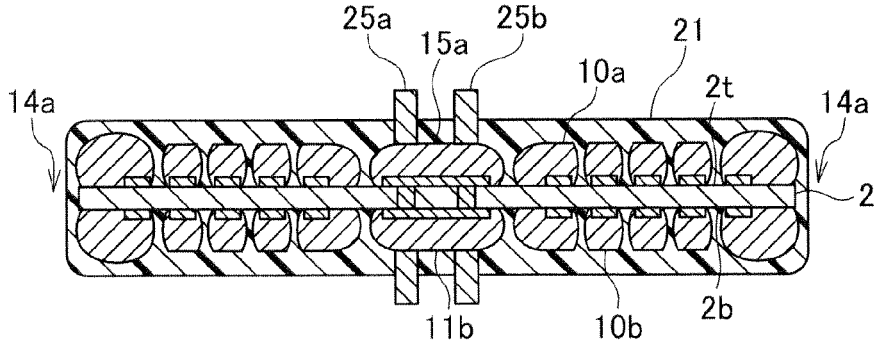
FIG. 7B is a cross-sectional view taken along the line A-A in FIG. 7A.

Subsequently, as shown in FIGS. 7A and 7B, an insulating resin is deposited on both surfaces of the substrate 2 to cover the conductors with the insulating resin layers 21*a* and 21*b*. Here, the bump electrodes are also covered with the insulating resin layers. The side walls of the through-holes 14*a* and 14*b* are also covered with the insulating resin, whereas the through-holes 14*a* and 14*b* need to be prevented from being fully filled with the insulating resin.

Figure 8A:
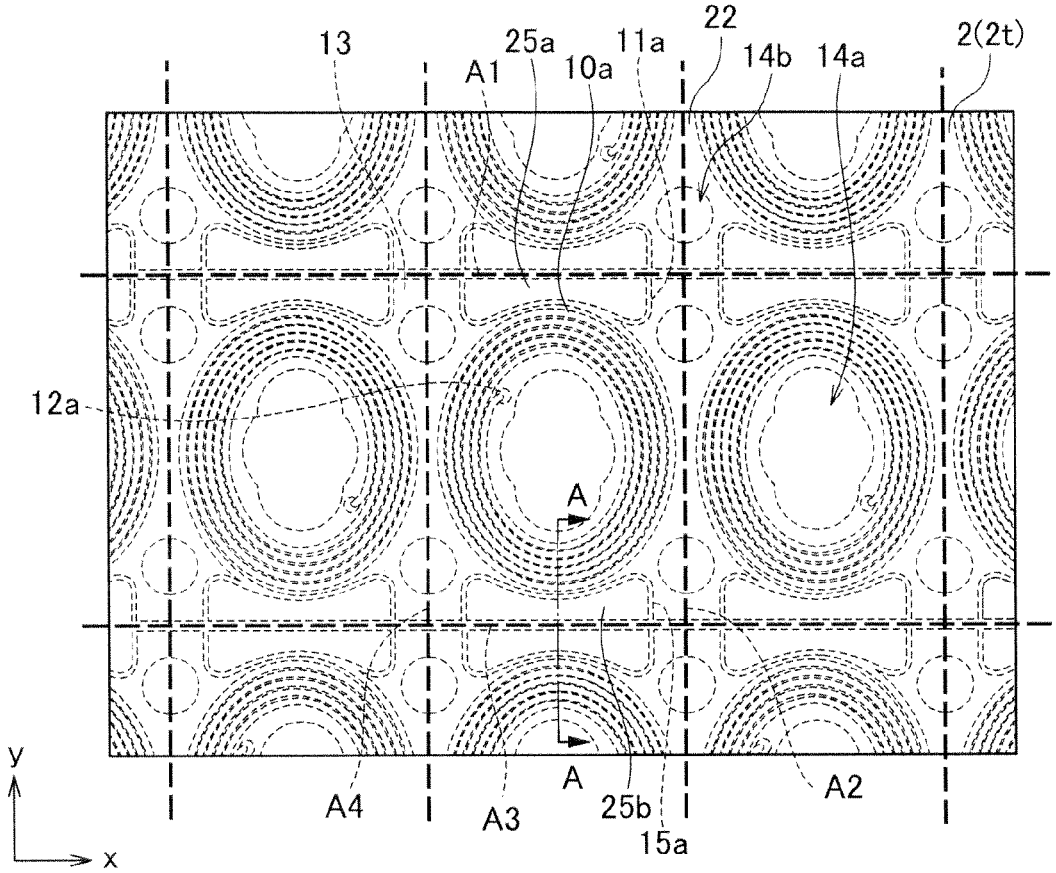
FIG. 8A is a diagram showing the coil component in the process of the mass-production steps of the coil component according to the first embodiment of the present invention and is a plan view of an uncut substrate seen from the top surface side.
Figure 8B:
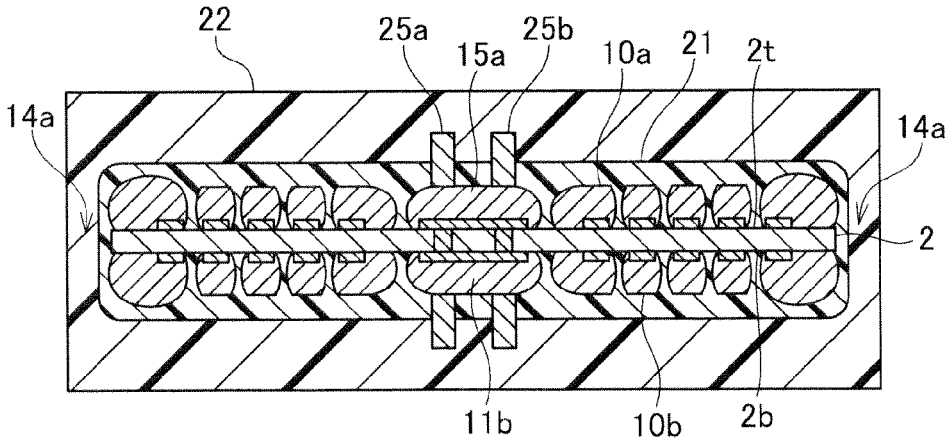
FIG. 8B is a cross-sectional view taken along the line A-A in FIG. 8A.

Next, as shown in FIGS. 8A and 8B, both surfaces of the substrate 2 are covered with the metal magnetic powder-containing resin layers 22*a* and 22*b*, respectively. A specific forming method will be described. Initially, a UV tape (not shown) for suppressing warpage of the substrate 2 is attached to the bottom surface 2*b* of the substrate 2. A metal magnetic powder-containing resin paste is screen-printed onto the top surface 2*t*. A thermal release tape may be used instead of the UV tape. After the screen printing, the paste is heated to cure. Next, the UV tape is removed, and the metal magnetic powder-containing resin paste is screen-printed onto the bottom surface 2*b*. By such processing, the metal magnetic powder-containing resin layers 22*a* and 22*b* are completed.

By the foregoing steps, the metal magnetic powder-containing resin layers 22*a* and 22*b* are also embedded in the through-holes 14*a* and 14*b*. This forms the through-hole magnetic bodies 22*c* and 22*d* shown in FIG. 1 in the through-holes 14*a* and 14*b*, respectively.

Figure 9A:
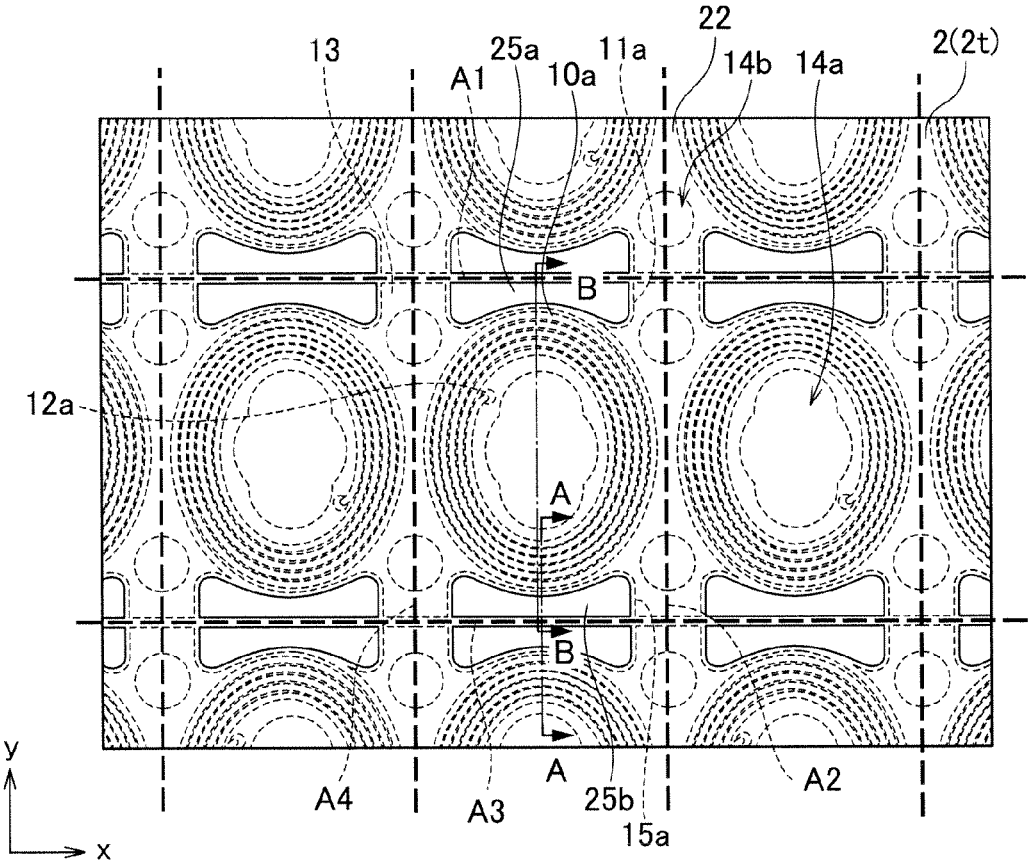
FIG. 9A is a diagram showing the coil component in the process of the mass-production steps of the coil component according to the first embodiment of the present invention and is a plan view of an uncut substrate seen from the top surface side.
Figure 9B:
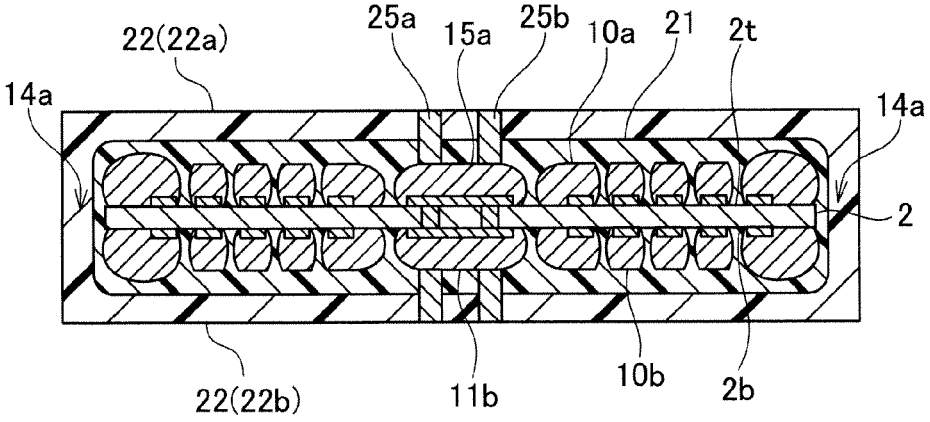
FIG. 9B is a cross-sectional view taken along the line A-A in FIG. 9A.

Next, as shown in FIGS. 9A and 9B, the surfaces of the metal magnetic powder-containing resin layers 22*a* and 22*b* are polished to adjust the thicknesses. The polishing also exposes the end portions of the bump electrodes 25*a* and 25*b* from the main surface of the metal magnetic powder-containing resin layer 22*a*.

Next, as shown in FIG. 10, an insulating layer 23 is formed on the surfaces of the metal magnetic powder-containing resin layers 22*a* and 22*b*. The insulating layer 23 is formed by chemically treating the surfaces of the metal magnetic powder-containing resin layers 22*a* and 22*b* with phosphate.

Next, as shown in FIG. 11, a pair of external electrodes 26*a* and 26*b* are formed on the surface of the metal magnetic powder-containing resin layer 22*a*. The external electrodes 26*a* and 26*b* are formed to cover the positions where the end portions of the bump electrodes 25*a* and 25 are exposed, and be electrically connected to the bump electrodes 25*a* and 25*b*. The external electrodes are preferably formed by sputtering. The external electrodes may be formed by screen printing.

Subsequently, the substrate 2 is cut along the cutting lines A1 to A4 by using a dicer. A coil component 1 is thus obtained from each individual rectangular area. Final plating processing is then performed to smoothen the electrode surfaces of the external electrodes 26*a* and 26*b*. The coil component 1 according to the present embodiment is thus completed.

As described above, in the method for manufacturing the coil component according to the present embodiment, the dummy lead conductors 15*a* and 15*b* respectively formed between the outermost turns of the planar spiral conductors 10*a* and 10*b* and the ends of the substrate 2 suppress the lateral growth of the plating layers 20 grown on the outermost turns of the planar spiral conductors 10*a* and 10*b* in the HAP step. The outermost turns of the planar spiral conductors 10*a* and 10*b* can thus be prevented from becoming extremely large in the line width.

The dummy lead conductor 15*a* is formed between the outermost turn of the planar spiral conductor 10*a* and the external electrode 26*a*. The dummy lead conductor 15*b* is formed between the outermost turn of the planar spiral conductor 10*b* and the external conductor 26*b*. This can prevent the outermost turns of the planar spiral conductors 10*a* and 10*b* and the external electrodes 26*a* and 26*b* from being short-circuited in an unintended position (position other than the lead conductors 11*a* and 11*b*).

The through-hole magnetic bodies are formed in the corner portions of the substrate 2 (cut substrate 2) and in the portion corresponding to the center portions of the planar spiral conductors 10*a* and 10*b*. This can improve the inductance of the coil component as compared to when such magnetic bodies are not formed.

Since the magnetic paths are formed not by a magnetic substrate but by the metal magnetic powder-containing resin layers 22*a* and 22*b*, a power supply choke coil having an excellent direct-current superimposition characteristic can be obtained.

In the power supply choke coil, the planar spiral conductors are maximized in thickness to reduce their direct-current resistance. The HAP step is performed for that purpose. The HAP step needs to pass a high current both in the x direction and the y direction. To produce a large number of coil components from a single substrate, the seed layers on the substrate need to be continuous even in the x direction. Short-circuit lines may be arranged between the planar spiral conductors to connect the outermost turns of the planar spiral conductors each other, in which case the planar spiral conductors are deformed with a drop in the coil characteristics and deterioration in appearance. The lead conductors and the dummy lead conductors continuous in the x direction favorably preclude such a problem.

The lead conductors and the dummy lead conductors are formed substantially in touch with the shorter sides of the substrate. If the magnetic path-forming through-holes are formed in the exact corner portions of the substrate, the continuity of the conductors in the x direction will be broken. Since the through-holes made of semicircular openings (notches) are formed somewhat closer to the center portion than the corner portions of the substrate, the continuity of the lead conductors and the dummy lead conductors in the x direction is not disturbed. This can prevent the planar spiral conductors from deteriorating in characteristic and appearance. In the present embodiment, the planar spiral conductors have an elliptic spiral shape, which makes it possible to form the magnetic path-forming through-holes having a semicircular shape in the foregoing positions while securing a sufficient loop size.

Figure 12:
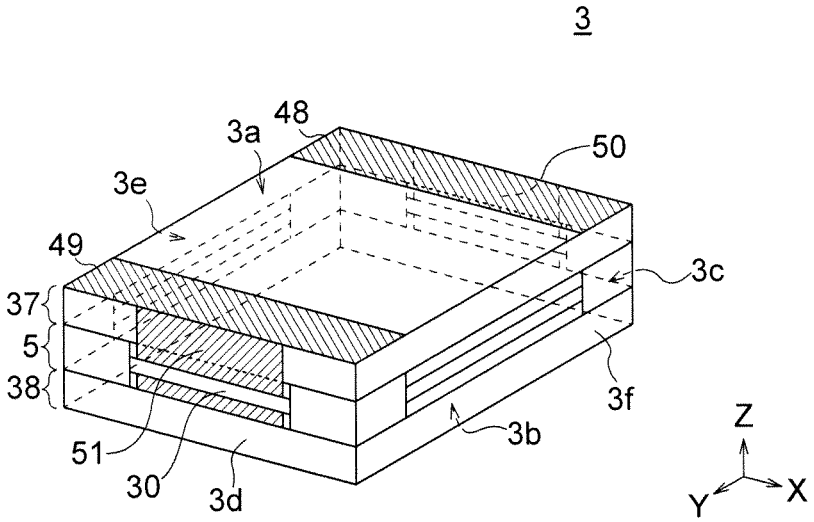
FIG. 12 is a schematic perspective view showing an appearance and shape of a coil component according to a second embodiment of the present invention.

FIG. 12 is a schematic perspective view showing an appearance and shape of a coil component 3 according to a second embodiment of the present invention.

As shown in FIG. 12, the coil component 3 according to the present embodiment is a chip component of surface mounting type. The coil component 3 includes a thin-film coil layer 5 including planar coil conductors, and first and second metal magnetic powder-containing resin layers 37 and 38 stacked on top and bottom of the thin-film coil layer 5. The coil component 3 has a rectangular solid shape in outline, and has a top surface 3*a*, a bottom surface 3*b*, and four side surfaces 3*c* to 3*f*.

A pair of external electrodes 48 and 49 are formed on the top surface 3*a* of the coil component 3 (the main surface of the first metal magnetic powder-containing resin layer 37). A pair of side electrodes 50 and 51 are arranged on two opposed side surfaces 3*c* and 3*d* of the coil component 3, respectively. The external electrode 48 and the side electrode 50 are combined to constitute one L-shaped electrode. The external electrode 49 and the side electrode 51 are combined to constitute the other L-shaped electrode. Such L-shaped electrodes can be used to form solder fillets when mounting the coil component 3. The coil component 3 is mounted with the top surface 3*a* downward so that the external electrodes 48 and 49 are opposed to a mounting surface. The thin-film coil layer 5 includes a substrate 30 for supporting the planar coil conductors. The side surfaces of the substrate 30 are exposed at the respective side surfaces 3*c* to 3*f* of the coil component 3. In particular, the side surfaces of the substrate 30 exposed at the side surfaces 3*c* and 3*d* of the coil component 3 are located in the forming areas of the side electrodes 50 and 51, respectively. The side electrodes 50 and 51 are thereby divided in the vertical direction.

Figure 13:
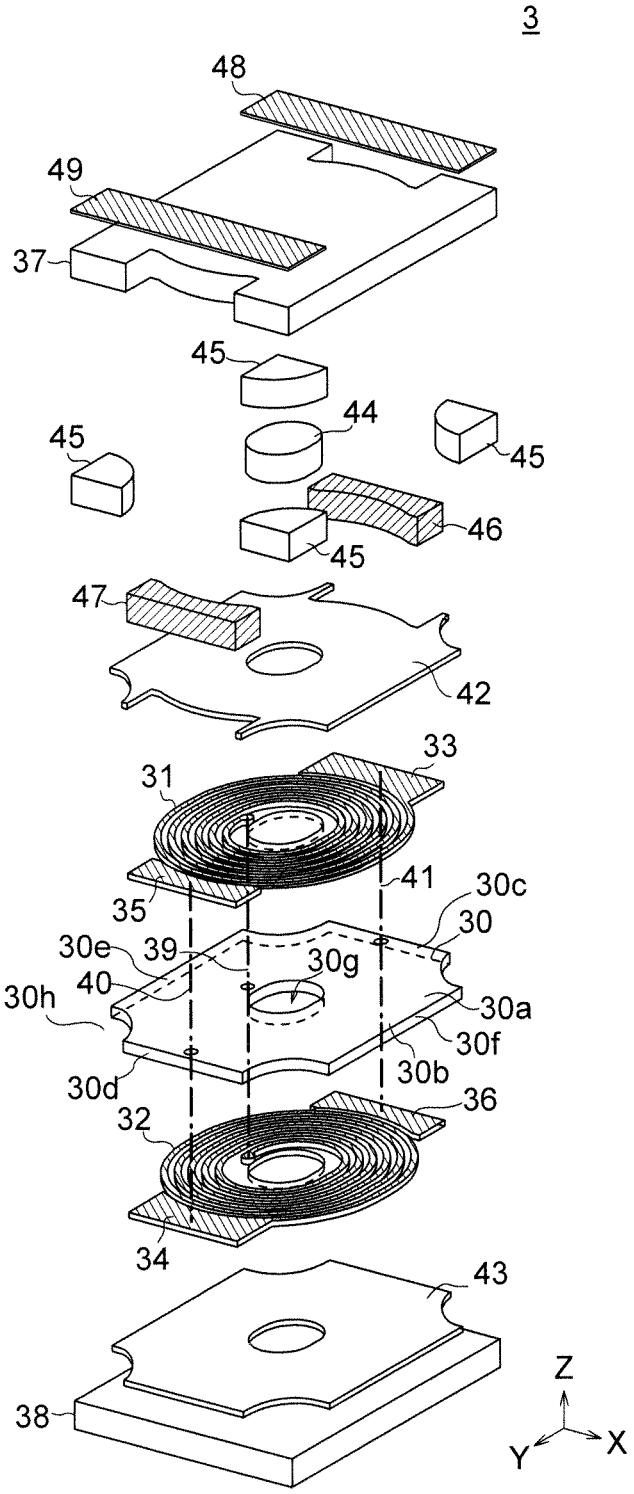
FIG. 13 is a schematic exploded perspective view of the coil component 3.

FIG. 13 is a schematic exploded perspective view of the coil component 3.

As shown in FIG. 13, the coil component 3 includes: the substrate 30; a first spiral conductor 31, a first terminal electrode 33, and a first dummy terminal electrode 35 which are formed on a top surface 30*a* (one main surface) of the substrate 30; a second spiral conductor 32, a second terminal electrode 34, and a second dummy terminal electrode 36 which are formed on a bottom surface 30*b* (the other main surface) of the substrate 30; and first and second metal magnetic powder-containing resin layers 37 and 38 which are formed on the top surface 30*a* and the bottom surface 30*b* of the substrate 30, respectively.

The substrate 30 has a rectangular planar shape in outline. The substrate 30 has two side surfaces 30*c* and 30*d* parallel to an X direction in the diagram, and two side surfaces 30*e* and 30*f* parallel to a Y direction. A first through-hole 30*g* is formed in a center portion of the substrate 30. The four corners of the substrate 30 are chamfered to form second through-holes 30*h* (notches) of quarter round shape. The substrate 30 therefore does not have a rectangular planar shape in a strict sense. The corner portions of the substrate 30 shall refer to the corner portions of the unchamfered, perfect rectangular substrate.

The first spiral conductor 31 is formed on the top surface 30*a* of the substrate 30. The second spiral conductor 32 is formed on the bottom surface 30*b* of the substrate 30. The inner peripheral ends of the first and second spiral conductors 31 and 32 are located in the same planar position and connected to each other via a first through-hole conductor 39 penetrating the substrate 30. In contrast, the outer peripheral end of the first spiral conductor 31 and the outer peripheral end of the second spiral conductor 32 are located on opposite sides with essential parts of the first and second spiral conductors 31 and 32 therebetween. More specifically, the outer peripheral end of the first spiral conductor 31 lies near the side surface 30*c* of the substrate 30. The outer peripheral end of the second spiral conductor 32 lies near the side surface 30*d* of the substrate 30.

The first spiral conductor 31 and the second spiral conductor 32 are wound in opposite directions. When seen from the top surface 30*a* side of the substrate 30, the first spiral conductor 31 is wound counterclockwise from the inner peripheral end to the outer peripheral end. When seen from the top surface 30*a* side of the substrate 30, the second spiral conductor 32 is wound clockwise from the inner peripheral end to the outer peripheral end. According to such a winding structure, when a current is passed from either one of the outer peripheral ends of the first and second spiral conductors 31 and 32 to the other, the currents flowing through the first and second spiral conductors 31 and 32 produce magnetic fields in the same direction to reinforce each other . The first and second spiral conductors 31 and 32 can thus function as a single inductor.

The first terminal electrode 33 is formed on the top surface 30*a* of the substrate 30, and connected to the outermost turn of the first spiral conductor 31. The first terminal electrode 33 is located outside the outermost turn of the first spiral conductor 31, and arranged in contact with the common side between the first side surface 30*c* and the top surface 30*a* of the substrate 30. An outer side surface of the first terminal electrode 33 thus forms the same plane with the side surface 30*c* of the substrate 30.

The second terminal electrode 34 is formed on the bottom surface 30*b* of the substrate 30, and connected to the outermost turn of the second spiral conductor 32. The second terminal electrode 34 is located outside the outermost turn of the second spiral conductor 32, and arranged in contact with the common side between the second side surface 30*d* and the bottom surface 30*b* of the substrate 30. An outer side surface of the second terminal electrode 34 thus forms the same plane with the side surface 30*d* of the substrate 30.

The first dummy terminal electrode 35 is formed on the top surface 30*a* of the substrate 30. The first dummy terminal electrode 35 is free from an electrical connection with the first spiral conductor 31 within the same plane, but is connected to the second terminal electrode 34 via a second through-hole conductor 40 penetrating the substrate 30. The first dummy terminal electrode 35 is located directly above the second terminal electrode 34 so as to overlap the second terminal electrode 34 when seen in a plan view, and has a planar shape somewhat smaller than the second terminal electrode 34. The first dummy terminal electrode 35 is located outside the outermost turn of the first spiral conductor 31, and arranged in contact with the common side between the second side surface 30*d* and the top surface 30*a* of the substrate 30. An outer side surface of the first dummy terminal electrode 35 thus forms the same plane with the second surface 30*d* of the substrate 30 and the second terminal electrode 34.

The second dummy terminal electrode 36 is formed on the bottom surface 30*b* of the substrate 30. The second dummy terminal electrode 36 is free from an electrical connection with the second spiral conductor 32 within the same plane, but is connected to the first terminal electrode 33 via a third through-hole conductor 41 penetrating the substrate 30. The second dummy terminal electrode 36 is located directly below the first terminal electrode 33 so as to overlap the first terminal electrode 33 when seen in a plan view, and has a planar shape somewhat smaller than the first terminal electrode 33. The second dummy terminal electrode 36 is located outside the outermost turn of the second spiral conductor 32, and arranged in contact with the common side between the first side surface 30*c* and the bottom surface 30*b* of the substrate 30. An outer side surface of the second dummy terminal electrode 36 thus forms the same plane with the first side surface 30*c* of the substrate 30 and the outer side surface of the first terminal electrode 33.

That the outer side surface of a terminal electrode (or dummy terminal electrode) forms the same plane with a side surface of the substrate 30 means only that the surfaces look to be the same plane so that the surfaces can be regarded as a side surface of the coil component. The side surfaces need not form exactly the same plane. For example, the outer side surface of a terminal electrode or dummy electrode may be formed slightly (for example, several to several tens of micrometers) higher than the corresponding side surface of the substrate 30 by barrel plating to be described later. As employed herein, such two surfaces may be regarded as the same plane.

An inner side surface of the first dummy terminal electrode 35 opposed to the outermost turn of the first spiral conductor 31 is curved to the shape of the outermost turn of the first spiral conductor 31. An inner side surface of the second dummy terminal electrode 36 opposed to the second spiral conductor 32 is similarly curved to the shape of the outermost turn of the second spiral conductor 32. Forming the inner side surfaces of the first and second dummy terminal electrodes 35 and 36 in such a curved shape can suppress the excessive lateral plating growth of the outermost turns of the first and second spiral conductors 31 and 32 to be described later. This allow the formation of a high-precision pattern. The space width between the spiral conductors and the dummy terminal electrodes is preferably set to be approximately equal to the pitch width of the spiral conductors. Such a setting can make the line width of the outermost turns the same as the width of the inner lines, which allows more precise pattern formation.

The first and second spiral conductors 31 and 32, the first and second terminal electrodes 33 and 34, and the first and second dummy terminal electrodes 35 and 36 are simultaneously formed by forming a base layer by electroless plating or the like, followed by two electrolytic plating steps. Cu is suitably used both as the material of the base layer and the plating material used in the two electrolytic plating steps. The second electrolytic plating step includes supplying a higher current than in the first electrolytic plating step to quickly form a thick plating layer. In the second plating step, the outermost and innermost turns of the spiral conductors can be laterally grown large by plating. According to the present embodiment, however, the provision of the dummy terminal electrodes 35 and 36 can prevent the outermost turns of the spiral conductors 31 and 32 from becoming extremely thick, whereby a desired line width can be maintained.

A first lead electrode 46 is formed on the top surface of the terminal electrode 33. A second lead electrode 47 is formed on the top surface of the dummy terminal electrode 35. The first and second lead electrodes 46 and 47 are formed by forming a resist pattern that covers the entire surface of the substrate 30 except the top surface of the terminal electrode 33 and the top surface of the dummy terminal electrode 35, and plating the exposed surfaces of the terminal electrode 33 and the dummy terminal electrode 35 for further growth.

The first lead electrode 46 preferably has a planar shape equivalent to or somewhat smaller than the shape of the first terminal electrode 33. The second lead electrode 47 preferably has a planar shape equivalent to or somewhat smaller than the shape of the first dummy terminal electrode 35. Such a configuration allows the reliable formation of the thick lead electrodes 46 and 47.

The first spiral conductor 31 formed on the top surface 30*a* side of the substrate 30 is covered with a thin insulating resin layer 42. The second spiral conductor 32, the second terminal electrode 34, and the second dummy terminal electrode 36 formed on the bottom surface 30*b* side of the substrate 30 are covered with a thin insulating resin layer 43. The insulating resin layers 42 and 43 are formed to prevent electrical conduction between the conductor patterns on the substrate 30 and the metal magnetic powder-containing resin layers 37 and 38.

The metal magnetic powder-containing resin layers 37 and 38 are formed on the top surface 30*a* and the bottom surface 30*b* of the substrate 30 from above the insulting resin layers 42 and 43, respectively.

The metal magnetic powder-containing resin layers 37 and 38 are made of a magnetic material (metal magnetic powder-containing resin) formed by mixing metal magnetic powder with resin serving as an insulating binder. Permalloy-based materials are suitably used as the metal magnetic powder. A specific example is metal magnetic powder that contains a Pb—Ni—Co alloy having an average particle size of 20 to 50 μm and carbonyl iron having an average particle size of 3 to 10 μm, mixed in a predetermined ratio such as a weight ratio of 70:30 to 80:20, preferably 75:25. The metal magnetic powder may contain an Fe—Si—Cr alloy instead of the Pb—Ni—Co alloy. In such a case, the content of the Fe—Si—Cr alloy (weight ratio with respect to carbonyl iron) may be the same as that of the Pb—Ni—Co alloy.

Liquid or powder epoxy resin is preferably used as the resin. The metal magnetic powder-containing resin layers preferably have a metal magnetic powder content of 90% to 97% by weight. The lower the content of the metal magnetic powder with respect to the resin, the lower the saturation flux density. The higher the content of the metal magnetic powder, the higher the saturation flux density.

As described above, the first through-hole 30*g* is formed in the center portion of the substrate 30. The second through-holes 30*b* of quarter round shape are formed in the corner portions at the four corners of the substrate 30, respectively. The metal magnetic powder-containing resin constituting the metal magnetic powder-containing resin layers 37 and 38 is also embedded in the through-holes 30*g* and 30*h*. As shown in FIG. 13, the embedded metal magnetic powder-containing resin constitutes through-hole magnetic bodies 44 and 45. The through-hole magnetic bodies 44 and 45, though not essential in the present invention, are intended to form a completely-closed magnetic circuit in the coil component 3.

The first and second external electrodes 48 and 49 are formed on the main surface of the metal magnetic powder-containing resin layer 37. Note that FIG. 13 shows the coil component 3 with the mounting surface upward. The external electrodes 48 and 49 are connected to the terminal electrodes 33 and 34 through the lead electrodes 46 and 47 penetrating the metal magnetic powder-containing resin layer 37, respectively. The external electrodes 48 and 49 are soldered to lands on a circuit substrate.

The external electrodes 48 and 49 are rectangular traces and have a greater area than the top surfaces of the lead electrodes 46 and 47 exposed from the main surface of the metal magnetic powder-containing resin layer 37. To increase the inductance of a coil, the coil forming area needs to be maximized. To design a coil forming area as large as possible within given dimensions, the terminal electrodes 33 and 34 and the dummy terminal electrodes 35 and 36 arranged outside the coil are preferably minimized. If the terminal electrodes 33 and 34 and the dummy terminal electrodes 35 and 36 are reduced in area, the top surfaces of the lead electrodes 46 and 47 formed thereon also become smaller in area. The top surfaces of such lead electrodes 46 and 47, if simply used as external electrodes, have too small an electrode area to maintain amounting strength. In the present embodiment, the external electrodes 48 and 49 having a greater area than the top surfaces of the lead electrodes 46 and 47 are therefore arranged to provide a desired mounting strength.

Although not shown in the diagram, a thin insulating layer is formed on the surfaces of the metal magnetic powder-containing resin layers 37 and 38. The insulating layer is formed by treating the surfaces of the metal magnetic powder-containing resin layers 37 and 38 with phosphate. The provision of the insulating layer can prevent electrical conduction between the external electrodes 48 and 49 and the metal magnetic powder-containing resin layers 37 and 38.

In the present embodiment, the first and second external electrodes 48 and 49 are formed on the main surface of the first metal magnetic powder-containing resin layer 37 (the top surface 3*a* of the coil component 3). The outer side surfaces of the first and second terminal electrodes 33 and 34, the outer side surfaces of the first and second dummy terminal electrodes 35 and 36, and the outer side surfaces of the first and second lead electrodes 46 and 47 are exposed at the side surfaces of the coil component 3. The first external electrode 48 constitutes an L-shaped electrode in combination with the first terminal electrode 33, the second dummy terminal electrode 36, and the first lead electrode 46. The second external electrode 48 constitutes an L-shaped electrode in combination with the second terminal electrode 34, the first dummy terminal electrode 35, and the second lead electrode 47. The L-shaped electrodes allow the formation of solder fillets at the time of surface mounting, whereby the mounting strength can be increased. The solder connection state can be visually examined for reliable mounting.

Figure 14:
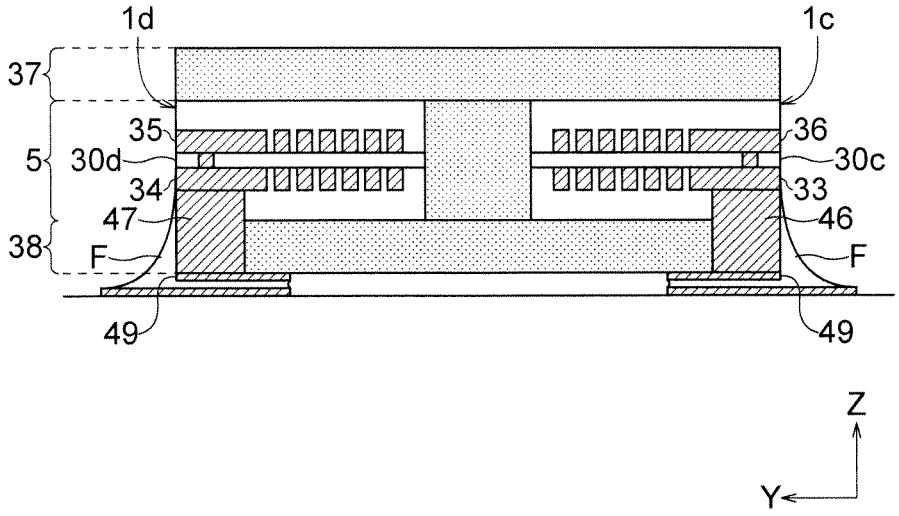
FIG. 14 is a schematic sectional side view showing a state of surface mounting of the coil component 3.

FIG. 14 is a schematic sectional side view showing a state of surface mounting of the coil component 3.

As shown in FIG. 14, according to the present embodiment, the side surface 30*c* of the substrate 30 sandwiched between the first terminal electrode 33 and the second dummy terminal electrode 36 is exposed at the side surface 3*c* of the coil component 3 along with the outer side surfaces of the first terminal electrode 33 and the second dummy terminal electrode 36. The side surface 30*d* of the substrate 30 sandwiched between the second terminal electrode 34 and the first dummy terminal electrode 35 is exposed at the side surface 3*d* of the coil component 3 along with the outer side surfaces of the second terminal electrode 34 and the first dummy terminal electrode 35. Such a configuration can suppress the height of solder fillets F at the time of reflow mounting. As shown in the diagram, the terminal electrodes and the dummy terminal electrodes are arranged with the substrate therebetween. If either the terminal electrodes or the dummy terminal electrodes are exposed, the others are also exposed. This inevitably increases the height of the side electrodes. If, for example, the upper part of the coil component 3 is covered with a metal shield cover, the exposure of the side electrodes causes the problem that the solder fillets F may make contact with the shield cover. However, the exposure of the side surfaces of the substrate 30 can prevent the solder from creeping up the side electrodes to adhere to the shield cover.

Next, a method for manufacturing the coil component 3 will be described.

FIGS. 15 to 20 are schematic diagrams for explaining mass-production steps of the coil component 3. FIGS. 15 to 20 are plan views of an uncut substrate 30 seen from the top surface 30*a* side. The broken lines shown in the diagrams represent cutting lines in a dicing step. Each individual rectangular area surrounded by the cutting lines (hereinafter, referred to simply as a "rectangular area") corresponds to a coil component 3. The following description focuses on the rectangular area at the center, surrounded by the cutting lines A1, A2, A4, and A5.

Figure 15:
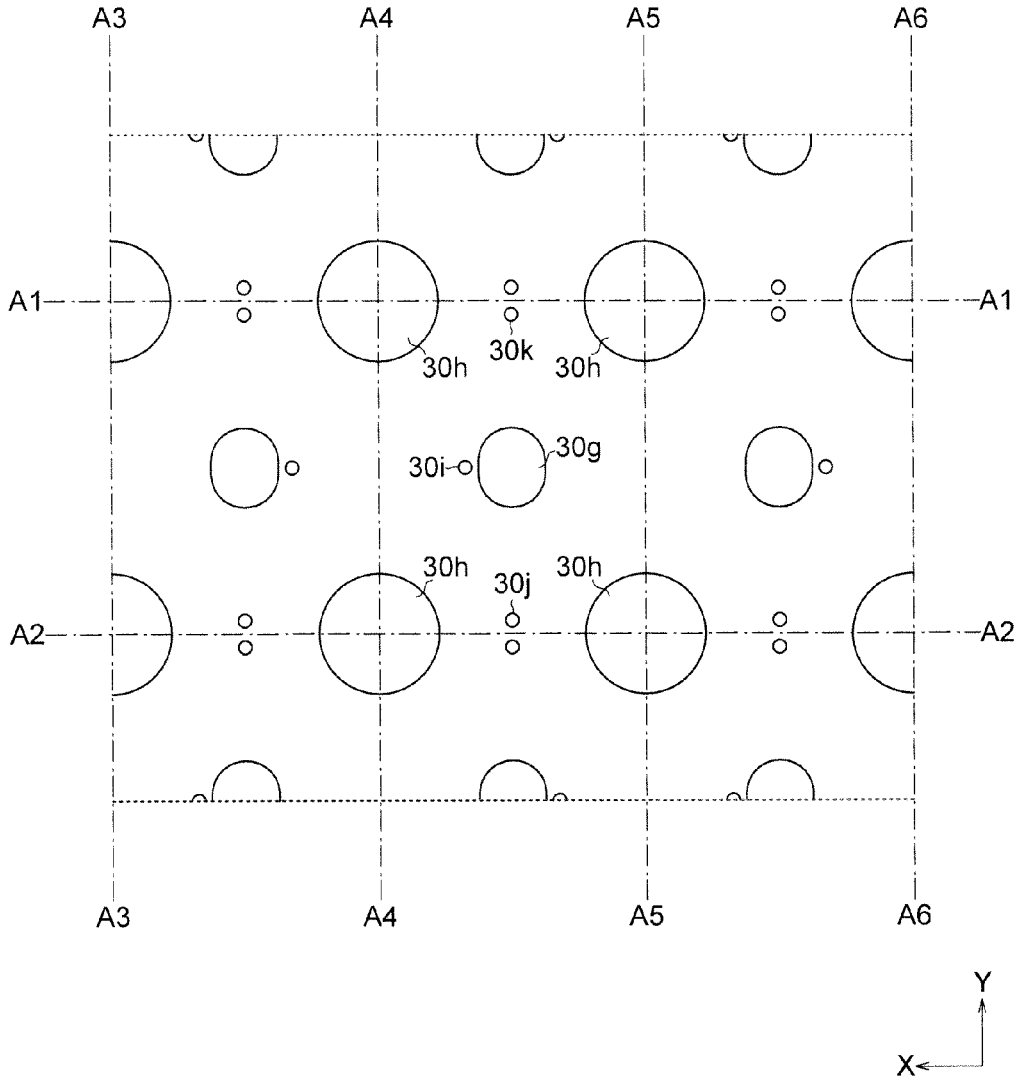
FIG. 15 is a schematic diagram for explaining mass-production steps of the coil component 3 and is a plan view of an uncut substrate 30 seen from the top surface 30*a* side.

Initially, as shown in FIG. 15, magnetic path-forming through-holes 30*g* and 30*h* and conductor-embedding through-holes 30*i*, 30*j*, and 30*k* are formed in the substrate 30. The through-holes 30*g*, 30*i*, 30*j*, and 30*k* are singly formed in each rectangular area. With respect to the pattern shape of the rectangular area at the center, the rectangular areas on the top, bottom, left, and right have a doubly-symmetrical pattern shape. The through-holes are therefore formed in different positions.

The through-holes 30*h* are a circular pattern, and are arranged at intersections between the cutting lines A1 and A2 extending in the X direction and the cutting lines A3, A4, A5, and A6 extending in the Y direction. A single through-hole 30*h* is common to four coil components. Each rectangular area is associated with four through-holes 30*h*. When the substrate 30 is cut at the positions of the cutting lines, through-holes 30*h* of quarter round shape (see FIG. 13) are obtained in the corner portions of each substrate.

Figure 16:
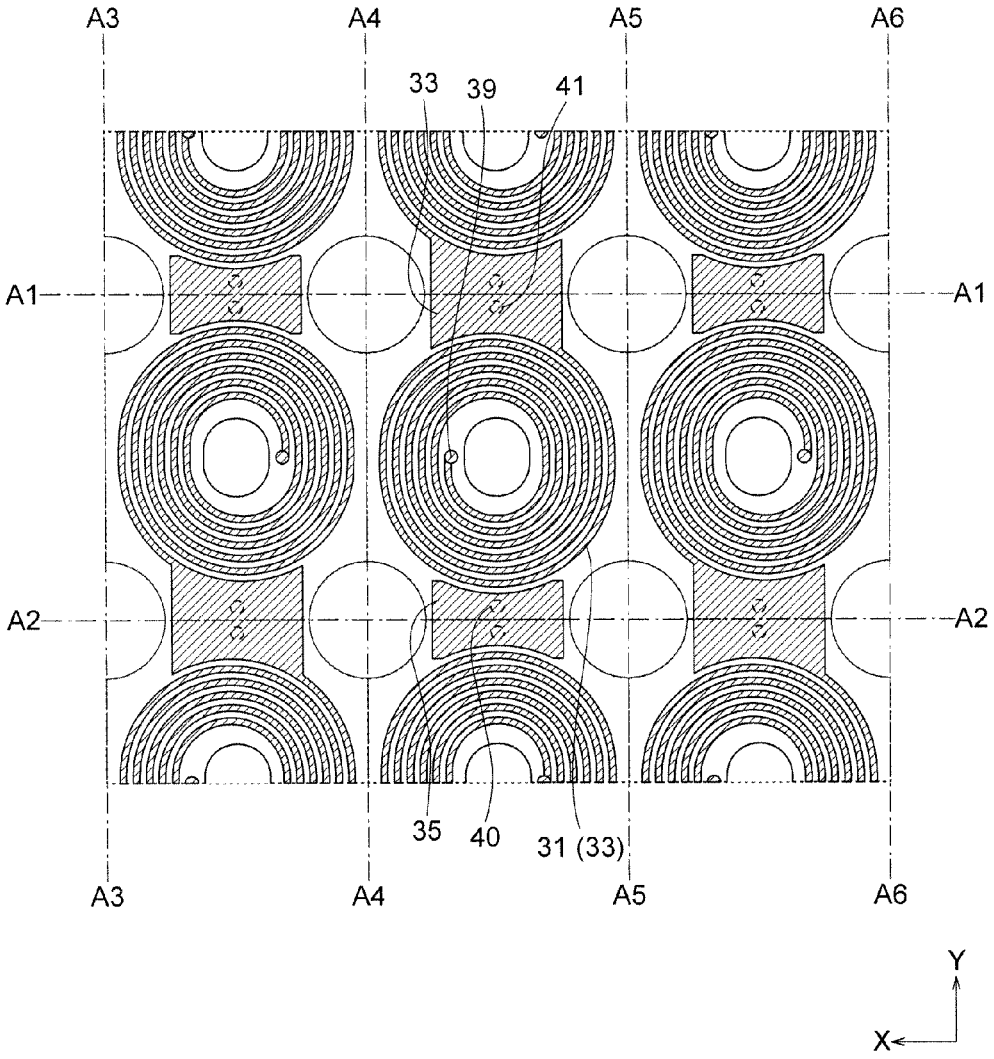
FIG. 16 is a schematic diagram for explaining mass-production steps of the coil component 3 and is a plan view of an uncut substrate 30 seen from the top surface 30*a* side.

Next, as shown in FIG. 16, the first spiral conductor 31, the first terminal electrode 33, and the first dummy terminal electrode 35 are formed in each rectangular area on the top surface 30*a* of the substrate 30. Such a conductor pattern can be formed by electrolytic plating to be described later. The inner peripheral end of the first spiral conductor 31, the first terminal electrode 33, and the first dummy terminal electrode 35 cover the through-holes 30*i*, 30*k*, and 30*j*, respectively. The electrode material fills the through-holes to form the first to third through-hole conductors 39, 40, and 41.

The first terminal electrode 33 is formed as a group electrode into which the first terminal electrodes 33 in two rectangular areas adjoining across the cutting line A1 are integrated. The first dummy terminal electrode 35 is also formed as a group electrode into which the first dummy terminal electrodes in two rectangular areas adjoining across the cutting line A2 are integrated.

Although not shown in the diagram, the second spiral conductor 32, the second terminal electrode 34, and the second dummy terminal electrode 36 are similarly formed in each rectangular area on the bottom surface 30*b* of the substrate 30. The inner peripheral end of the second spiral conductor 32, the second terminal electrode 34, and the second dummy terminal electrode 36 cover the through-holes 30*i*, 30*j*, and 30*k*, respectively. The inner peripheral end of the second spiral conductor 32, the second terminal electrode 34, and the second dummy terminal electrode 36 are thereby connected to the inner peripheral end of the first spiral conductor 31, the first dummy terminal electrode 35, and the first terminal electrode 33 via the first to third through-hole conductors 39, 40, and 41, respectively.

The second terminal electrode 34 is formed as a group electrode into which the second terminal electrodes 34 in two adjoining rectangular areas are integrated. The second dummy terminal electrode 36 is also formed as a group electrode into which the second dummy terminal electrodes 36 in two adjoining rectangular areas are integrated.

A specific method for forming the conductor patterns on the top surface 30*a* and the bottom surface 30*b* of the substrate 30 will be described below.

Initially, a Cu base layer is formed on the entire surfaces of the top surface 30*a* and the bottom surface 30*b* of the substrate 30. The base layers can be formed by electroless plating or sputtering. Next, photoresist layers are formed on the surfaces of the base layers. For example, the photoresist layers can be formed by pasting a sheet resist. The base layers are also formed on the inner wall surfaces of the through-holes. Next, opening patterns (negative patterns) of the first and second spiral conductors 31 and 32, the first and second terminal electrodes 33 and 34, and the first and second dummy terminal electrodes 35 and 36 are formed in the photoresist layers by photolithography.

Next, a first electrolytic plating step (first plating step) is performed. The first electrolytic plating step includes immersing the substrate 30 into a plating solution while passing a plating current through the base layers, whereby the portions of the base layers exposed from the opening patterns are grown by plating. Since the base layers are unpatterned planar conductors, the problem with the flowing direction of the plating current will not occur. The photoresist layers are then removed, and unnecessary portions of the base layers are further removed by etching. The steps so far complete basic patterns of the first and second spiral conductors 31 and 32, the first and second terminal electrodes 33 and 34, and the first and second dummy terminal electrodes 35 and 36 each including a base layer and a plating layer.

Next, a second electrolytic plating step (second plating step) is performed. The second electrolytic plating step includes immersing the substrate 30 into a plating solution while passing an extremely high plating current through the basic patterns to form thicker conductor patterns. Since the conductor patterns in the rectangular areas are connected in the X direction as well as the Y direction, the plating current flows both in the X direction and the Y direction. As a result, metal ions can be uniformly electrodeposited to form plating layers of uniform thickness.

The second electrolytic plating step can significantly increase the thicknesses of the conductor patterns. The reason for the provision of such large thicknesses of the conductor patterns is that the coil component 3 according to the present embodiment is a power supply coil and an extremely low direct-current resistance is needed.

Figure 21A:
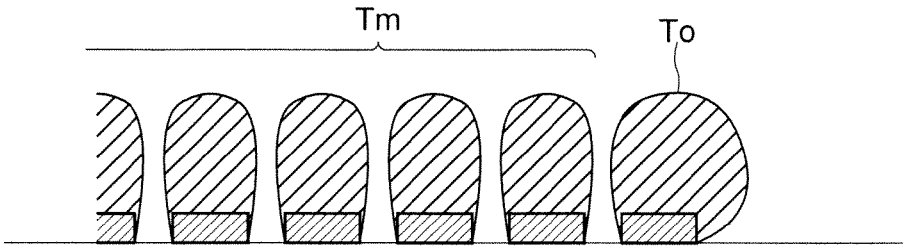
FIGS. 21A and 21B are schematic diagrams for explaining the function of the dummy terminal electrodes.
Figure 21B:
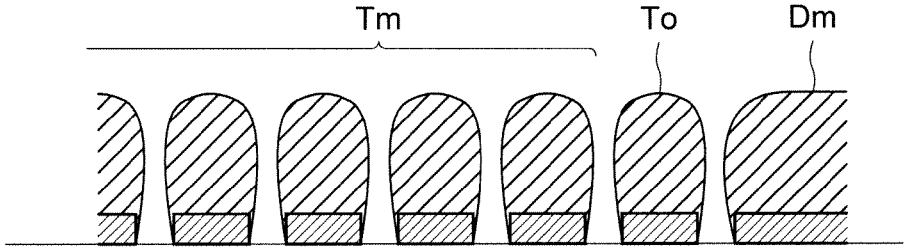

FIGS. 21A and 21B are schematic diagrams for explaining the function of the dummy terminal electrodes.

As shown in FIG. 21A, the second electrolytic plating step tends to laterally grow large the plating layer of the outermost turn To of a spiral conductor where there is no adjoining turn as compared to that of intermediate turns Tm. The outermost turn To thus tends to have an extremely large line width. In the present embodiment, as shown in FIG. 21B, a dummy terminal electrode Dm is arranged outside the outermost turn to create a gap of certain width between the outermost turn To of the spiral conductor and the dummy terminal electrode Dm. This can suppress the lateral plating growth of the outermost turn To of the spiral conductor. The outermost turn of the spiral conductor can thus be prevented from becoming extremely large in the line width.

Figure 17:
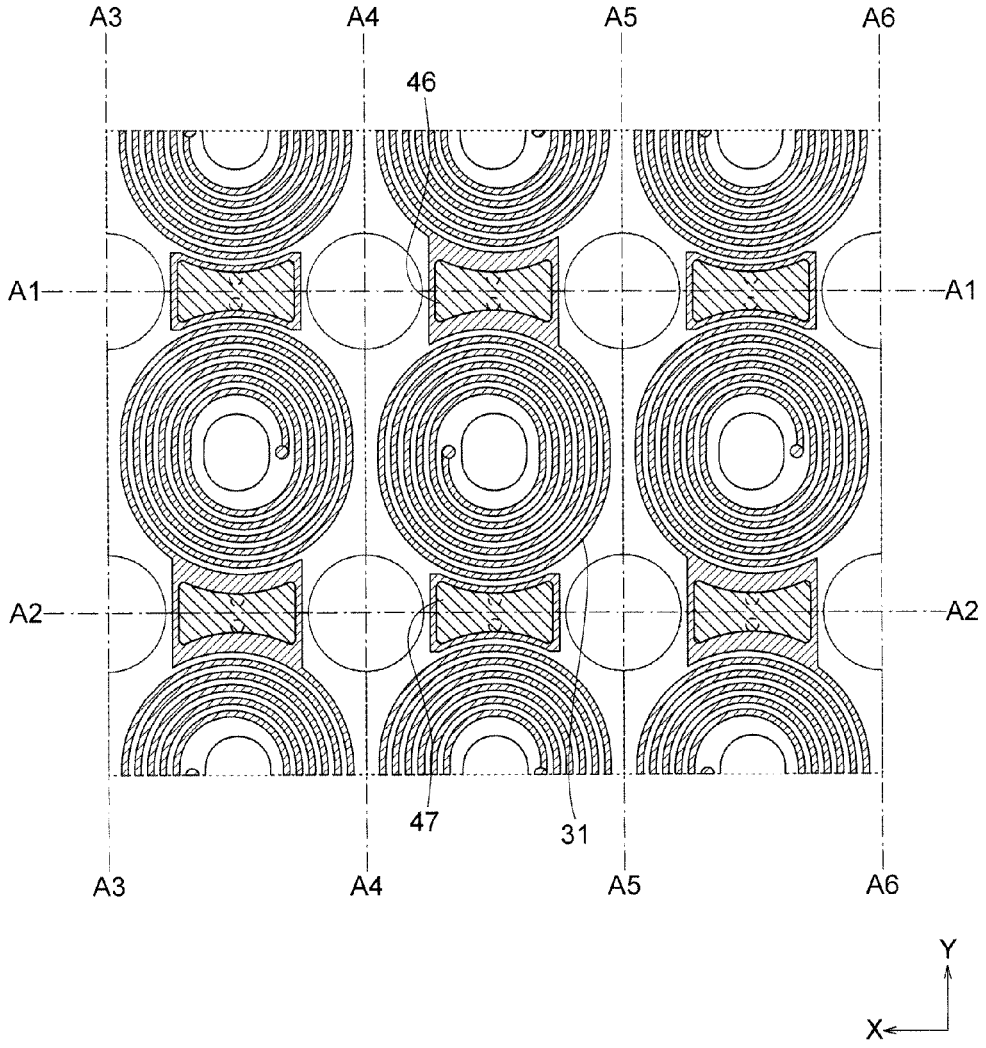
FIG. 17 is a schematic diagram for explaining mass-production steps of the coil component 3 and is a plan view of an uncut substrate 30 seen from the top surface 30*a* side.

Next, as shown in FIG. 17, the top surfaces of the first terminal electrode 33 and the first dummy terminal electrode 35 are selectively grown by plating to form the first and second lead conductors 46 and 47, respectively. The first and second lead electrodes 46 and 47 are each formed as a group electrode into which the first lead electrodes 46 or the second lead electrodes 47 in two rectangular areas adjoining across the cutting line A1 or A2 are integrated. To form the first and second lead electrodes 46 and 47, a photoresist layer is formed on the entire surface of the substrate. A negative pattern (opening pattern) of the first and second lead electrodes 46 and 47 is formed in the photoresist layer by photolithography.

Next, a third electrolytic plating step (third plating step) is performed. The third plating step also includes immersing the substrate 30 into a plating solution while passing an extremely high plating current, whereby the even thicker lead electrodes 46 and 47 are formed. The photoresist layer is then removed. By such steps, the first and second lead electrodes 46 and 47 made of plating layers are formed.

Figure 18:
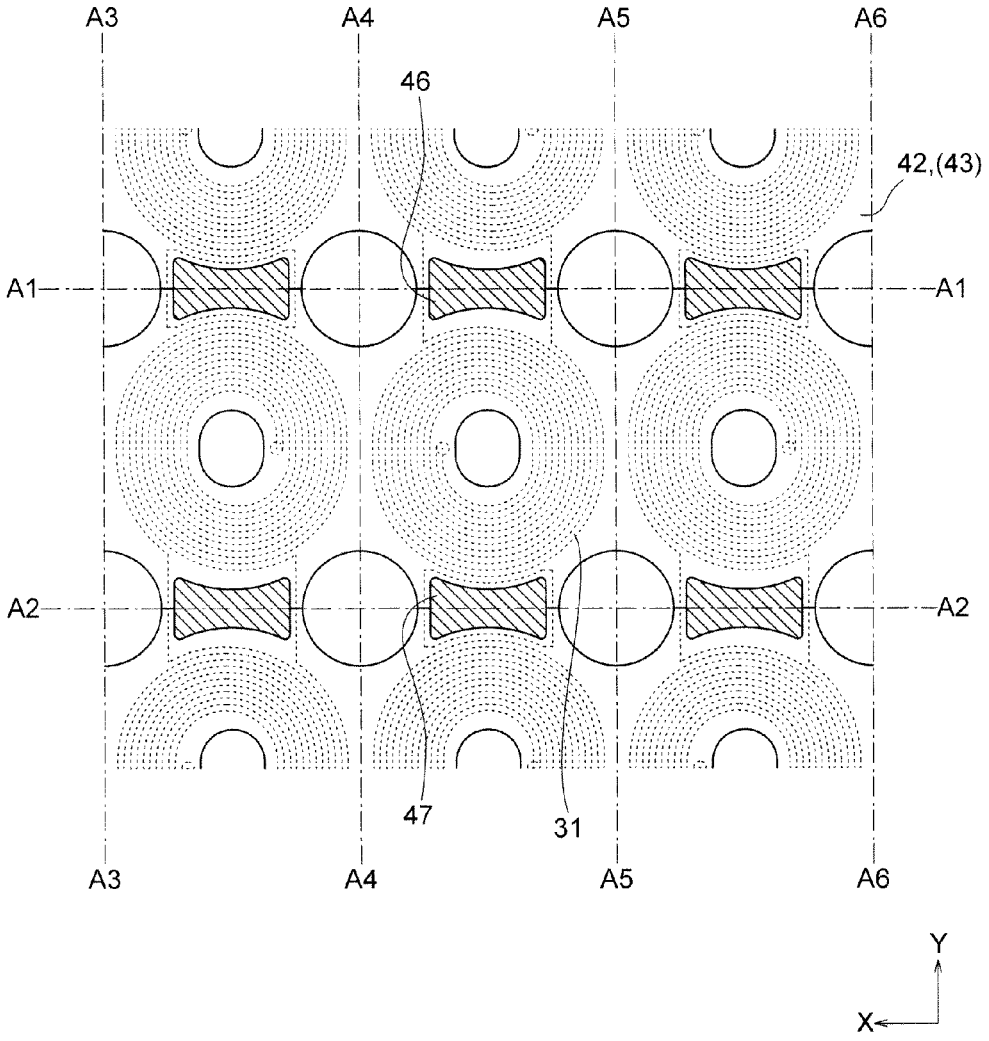
FIG. 18 is a schematic diagram for explaining mass-production steps of the coil component 3 and is a plan view of an uncut substrate 30 seen from the top surface 30*a* side.

Subsequently, as shown in FIG. 18, an insulting resin is deposited on both surfaces of the substrate 30 to cover the conductors with the insulating resin layers 42 and 43. Here, the lead electrodes are also covered with the insulating resin layer 42. The side walls of the through-holes 30*g* and 30*h* are also covered with the insulating resin, whereas the through-holes 30*g* and 30*h* need to be prevented from being fully filled with the insulating resin.

Figure 19:
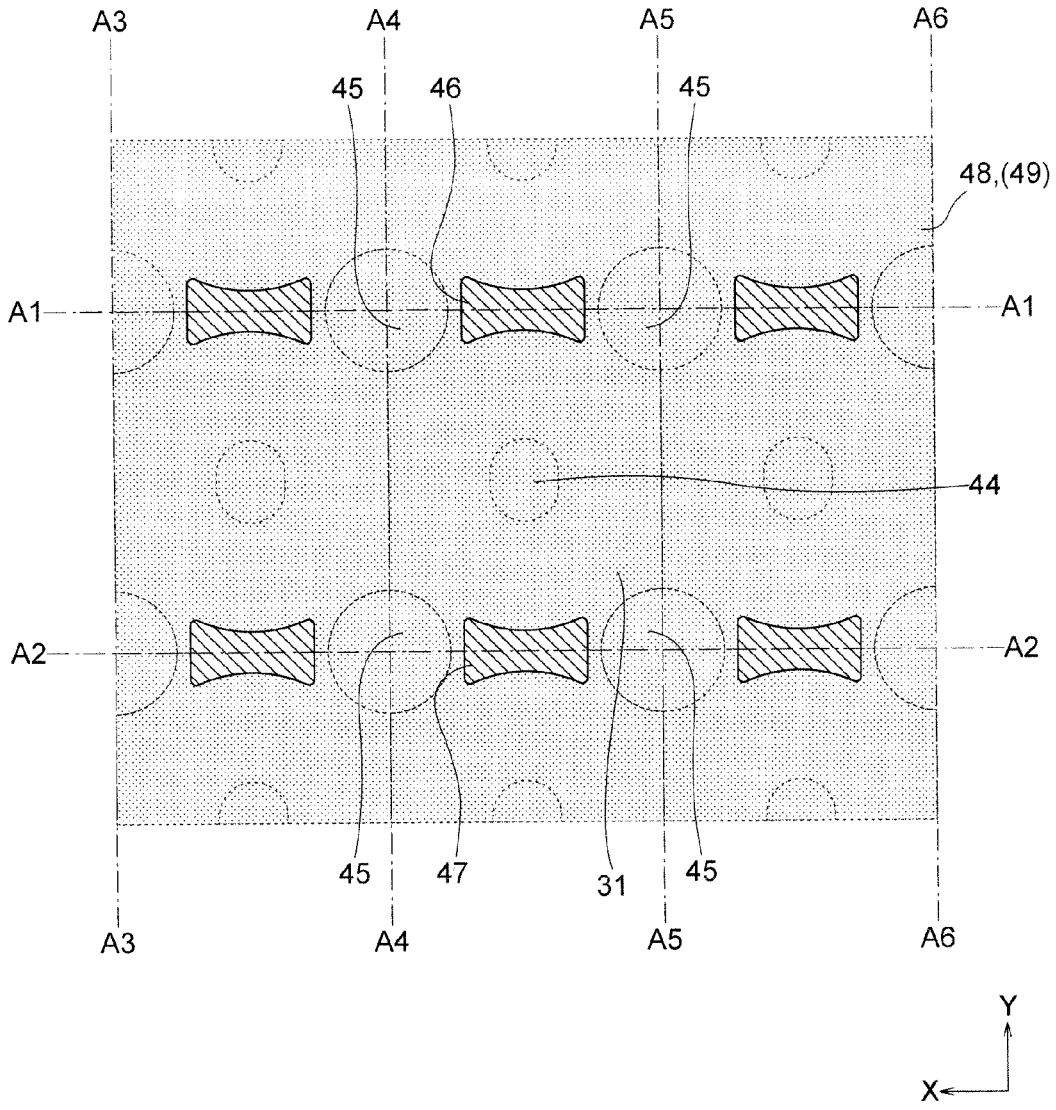
FIG. 19 is a schematic diagram for explaining mass-production steps of the coil component 3 and is a plan view of an uncut substrate 30 seen from the top surface 30*a* side.

Next, as shown in FIG. 19, the metal magnetic powder-containing resin layers 37 and 38 are formed on the respective surfaces of the substrate 30. Specifically, a UV tape (not shown) for suppressing warpage of the substrate 30 is attached to the bottom surface 30*b* of the substrate 30. A metal magnetic powder-containing resin paste is screen-printed onto the top surface 30*a*, and the paste is heated to cure. A thermal release tape may be used instead of the UV tape. Next, the UV tape is removed, and the metal magnetic powder-containing resin paste is screen-printed onto the bottom surface 30*b* of the substrate 30. The paste is heated to cure. The surfaces of the metal magnetic powder-containing resin layers 37 and 38 are then polished to adjust the thicknesses. Here, the end portions of the lead electrodes 46 and 47 are exposed from the main surface of the metal magnetic powder-containing resin layer 37. By such processing, the metal magnetic powder-containing resin layers 37 and 38 are completed. The metal magnetic powder-containing resin paste is also embedded into the through-holes 30*g* and 30*h*, whereby the through-hole magnetic bodies 44 and 45 shown in FIGS. 12 and 13 are formed.

Figure 20:
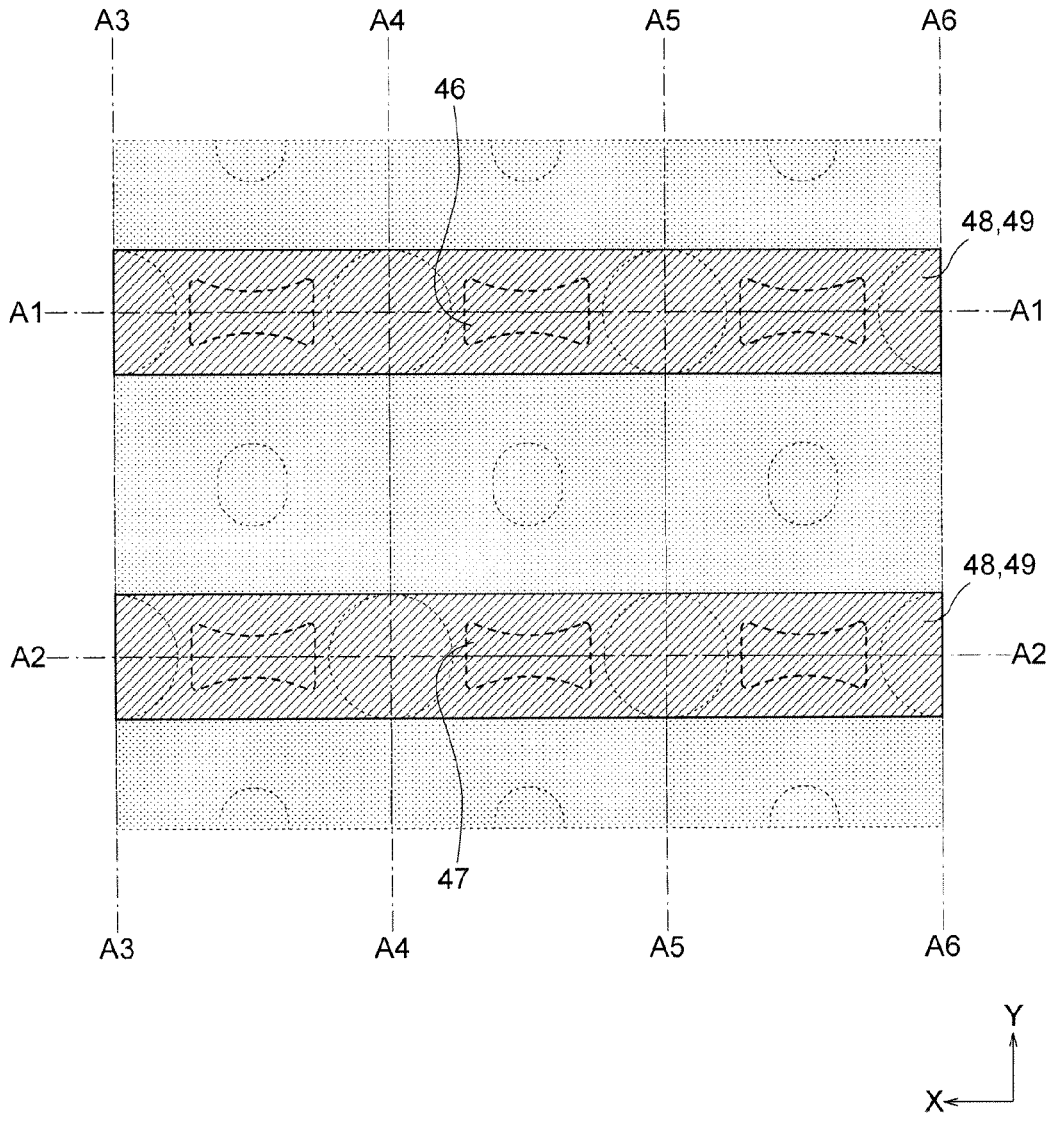
FIG. 20 is a schematic diagram for explaining mass-production steps of the coil component 3 and is a plan view of an uncut substrate 30 seen from the top surface 30*a* side.

Next, as shown in FIG. 20, the first and second external electrodes 48 and 49 are formed on the surface of the metal magnetic powder-containing resin layer 37. The first and second external electrodes 48 and 49 are each formed as a group electrode into which the external electrodes in two rectangular areas adjoining across the cutting line A1 or A2 are integrated.

To form the first and second external electrodes 48 and 49, an insulating resin layer is initially formed on the surfaces of the metal magnetic powder-containing resin layers 37 and 38. The insulating resin layer is formed by chemically treating the surfaces of the metal magnetic powder-containing resin layers 37 and 38 with phosphate. Subsequently, the first and second external electrodes 48 and 49 are formed to cover the positions where the end portions of the first and second lead electrodes 46 and 47 are exposed, and be electrically connected to the lead electrodes 46 and 47. The external electrodes are preferably formed by sputtering. The external electrodes may be formed by screen printing.

Subsequently, the substrate 30 is diced along the cutting lines A1 to A4. A coil component 3 is thus obtained from each individual rectangular area. As shown in FIGS. 12 to 14, the dicing exposes the outer side surfaces of the terminal electrodes 33 and 34, the dummy terminal electrodes 35 and 36, and the lead electrodes 46 and 47 at the side surfaces of each coil component. The side surfaces 30*c* and 30*d* of the substrate 30 are also exposed along with the electrode surfaces.

Final plating processing (barrel plating) is then performed to smoothen the electrode surfaces of the first and second terminal electrodes 33 and 34, the first and second dummy terminal electrodes 35 and 36, and the first and second external electrodes 48 and 49. The coil component 3 according to the present embodiment is thus completed.

As has been described above, in the method for manufacturing the coil component according to the present embodiment, the first and second dummy terminal electrodes 35 and 36 are formed outside the outermost turns of the spiral conductors 31 and 32, respectively. The second electrolytic plating step is then performed to form the thick first and second spiral conductors 31 and 32. This can suppress the lateral plating growth of the plating layers of the outermost turns. The outermost turns of the spiral conductors 31 and 32 can thus be prevented from becoming extremely large in the line width.

Figure 22:
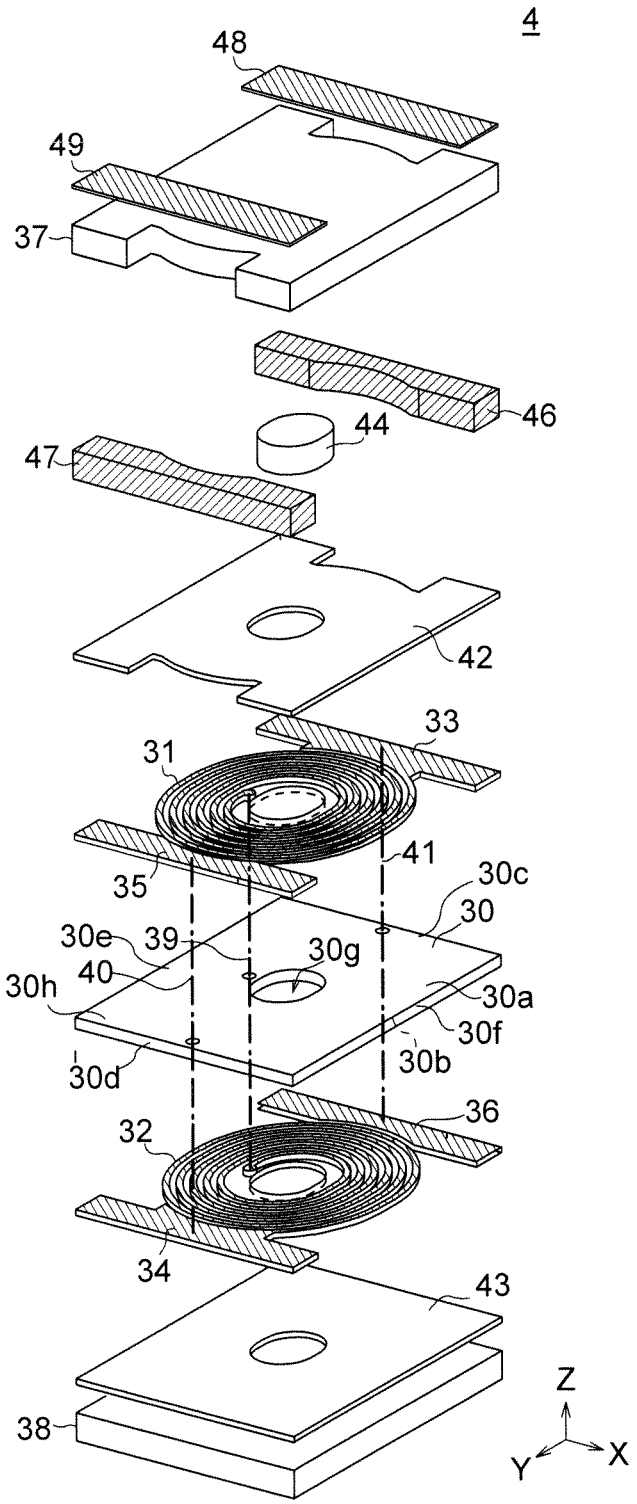
FIG. 22 is a schematic exploded perspective view showing the configuration of a coil component 4 according to a third embodiment of the present invention.

FIG. 22 is a schematic exploded perspective view showing the configuration of a coil component 4 according to a third embodiment of the present invention.

As shown in FIG. 22, the coil component 4 according to the present embodiment is characterized by that the through-hole magnetic bodies 25 arranged in the corner portions of the substrate 30 are omitted. The substrate 30 has no through-hole 30*h*. The side surfaces 30*c* and 30*d* of the substrate 30 have the same width as the maximum width of the substrate. Being tailored to the shape of the substrate 30, the first and second terminal electrodes 33 and 34 and the first and second dummy terminal electrodes 35 and 36 also have the same width as that of the side surfaces 30*c* and 30*d*. According to the present embodiment, like the coil component 3 according to the second embodiment, the side surfaces 30*c* and 30*d* of the substrate 30 sandwiched between the terminal electrodes 33 and 34 and the dummy terminal electrodes 35 and 36 are exposed along with the terminal electrodes and the dummy terminal electrodes. This can suppress the height of solder fillets. Thickening of the outermost turns of the first and second spiral conductors can also be suppressed over a wider range. In the mass-production steps, adjoining terminal electrodes can be laterally connected to increase the paths of a plating current, whereby in-plane variations in the thickness of the plating layers can be reduced.

The present invention has thus been shown and described with reference to specific embodiments. However, it should be noted that the present invention is in no way limited to the details of the described arrangements but changes and modifications may be made without departing from the scope of the appended claims.

For example, in the foregoing embodiments, the planar spiral conductors are formed on both sides of the substrate. However, the present invention is not limited to such a configuration. A planar spiral conductor may be formed on either one side of the substrate.

In the first embodiment, the bump electrodes have a planar shape somewhat smaller than the shape of the lead conductors and the dummy lead conductors. However, in the present invention, the shape of the bump electrodes is not limited in particular. For example, a bump electrode may be made of at least one through-hole conductor.

In the foregoing embodiments, the planar spiral conductors have an elliptic spiral shape. However, the planar spiral conductors according to the present invention may have other circular spiral shapes like an oblong circular spiral and a perfect circular spiral.

In the first embodiment, the third through-hole conductor 21 is arranged to connect the first terminal electrode 13 and the second dummy terminal electrode 16. However, the third through-hole conductor 21 may be omitted. The forming positions, shapes, and numbers of through-hole magnetic bodies 22*d* are 45 are arbitrary, and not limited to the foregoing first and second embodiments.

The foregoing embodiments have dealt with the coil components where the first and second spiral conductors are formed on both sides of a substrate. However, the present invention is also applicable to a coil component that includes a stack of a plurality of such substrates.

What is claimed is:

1. A coil component comprising:

a substrate;

a planar spiral conductor that is formed on a surface of the substrate by electrolytic plating;

a lead conductor that is formed on the surface of the substrate and connected to an outer peripheral end of the planar spiral conductor;

a dummy lead conductor that is formed on the surface of the substrate and between an outermost turn of the planar spiral conductor and an end of the substrate, and free from an electrical connection with another conductor at least within the same plane;

an insulating resin layer that is formed on the surface of the substrate to cover the planar spiral conductor, the lead conductor, and the dummy lead conductor;

a metal magnetic powder-containing resin layer that covers the insulating resin layer;

an external electrode that is formed on the metal powder-containing resin layer; and a bump electrode that penetrates the insulating resin layer and the metal magnetic power-containing resin layer and is connected between the lead conductor and the external electrode, wherein the external electrode has an area greater than that of the bump electrode, the metal magnetic powder-containing resin layer has a main surface that is substantially parallel to the surface of the substrate and a side surface that is substantially perpendicular to the main surface, and the external electrode is selectively formed on the main surface of the metal magnetic powder-containing resin layer so that the side surface of the metal magnetic powder-containing resin layer is free from the external electrode.

2. The coil component as claimed in claim 1, wherein the planar spiral conductor has a circular spiral shape, and a side surface of the dummy lead conductor opposed to the planar spiral conductor is curved along the outermost turn of the planar spiral conductor.

3. The coil component as claimed in claim 1 further comprising a first through-hole magnetic body and second through-hole magnetic bodies, the first and second through-hole magnetic bodies being made of the same material as that of the metal magnetic powder-containing resin layer, wherein the first through-hole magnetic body penetrates the substrate in a center portion surrounded by the planar spiral conductor, and the second through-hole magnetic bodies penetrate the substrate outside the planar spiral conductor.

4. The coil component as claimed in claim 3, wherein the substrate has a rectangular shape, the planar spiral conductor has an elliptical spiral shape, and the second through-hole magnetic bodies are formed corresponding to each of four corners of the substrate.

5. The coil component as claimed in claim 4, wherein the substrate includes first and second sides that are parallel to each other, and third and fourth sides that are orthogonal to the first and second sides and parallel to each other, the lead conductor is extended along the first side, the dummy lead conductor is extended along the second side, and the second through-hole magnetic bodies are arranged on the third or fourth sides.

6. The coil component as claimed in claim 5, wherein the bump electrode is extended along the first side.

7. A coil component comprising:

a substrate having top and bottom surfaces;

a first planar spiral conductor that is formed on the top surface of the substrate by electrolytic plating;

a second planar spiral conductor that is formed on the bottom surface of the substrate by electrolytic plating;

a first through-hole conductor that penetrates the substrate to connect an inner peripheral end of the first planar spiral conductor with an inner peripheral end of the second planar spiral conductor;

a first dummy lead conductor that is formed on the top surface of the substrate and between an outermost turn of the first planar spiral conductor and an end of the substrate, and free from an electrical connection with another conductor at least within the same plane;

a second dummy lead conductor that is formed on the bottom surface of the substrate and between an outermost turn of the second planar spiral conductor and an end of the substrate, and free from an electrical connection with another conductor at least within the same plane;

a first lead conductor that is formed on the top surface of the substrate and vertically overlapped with the second dummy lead conductor, and is connected to an outer peripheral end of the first planar spiral conductor;

a second lead conductor that is formed on the bottom surface of the substrate and vertically overlapped with the first dummy lead conductor, and is connected to an outer peripheral end of the second planar spiral conductor;

a second through-hole conductor that penetrates the substrate to connect the first dummy lead conductor with the second lead conductor;

first and second external electrodes that are formed in parallel with the top surface of the substrate;

a first bump electrode that is formed on a surface of the first lead conductor by electrolytic plating and connects the first lead conductor with the first external electrode; and a second bump electrode that is formed on a surface of the first dummy lead conductor by electrolytic plating and connects the first dummy lead conductor with the second external electrode, wherein the first external electrode has an area greater than that of the first bump electrode, and the second external electrode has an area greater than that of the second bump electrode.

8. The coil component as claimed in claim 7, wherein the first and second planar spiral conductors have a circular spiral shape, a side surface of the first dummy lead conductor opposed to the first planar spiral conductor is curved along the outermost turn of the first planar spiral conductor, and a side surface of the second dummy lead conductor opposed to the second planar spiral conductor is curved along the outermost turn of the second planar spiral conductor.

9. The coil component as claimed in claim 7 further comprising:

a first metal magnetic powder-containing resin layer that is arranged on a top surface side of the substrate; and a second metal magnetic powder-containing resin layer that is arranged on a bottom surface side of the substrate, wherein each of the first and second external electrodes is formed not on a side surface but selectively on a main surface of the first metal magnetic powder-containing resin layer, and the first and second bump electrodes penetrate the first metal magnetic powder-containing resin layer and are connected to the first and second electrode external electrodes, respectively.

10. The coil component as claimed in claim 9 further comprising first and second through-hole magnetic bodies that are made of the same material as that of the first and second metal magnetic powder-containing resin layers, and penetrate the substrate to connect the first metal magnetic powder-containing resin layer with the second metal magnetic powder-containing resin layer, wherein the first through-hole magnetic body penetrates the substrate in a center portion surrounded by the first and second planar spiral conductors, and the second through-hole magnetic bodies penetrate the substrate outside the first and second planar spiral conductors.

11. The coil component as claimed in claim 10 wherein the substrate has a rectangular shape, the first and second planar spiral conductors have an elliptical spiral shape, and the second through-hole magnetic bodies are formed corresponding to each of four corners of the substrate.

12. A coil component comprising:

a substrate having top and bottom surfaces opposite to each other;

a first spiral conductor formed on the top surface of the substrate;

a second spiral conductor formed on the bottom surface of the substrate;

a first conductor formed on the top surface of the substrate and connected to an outer peripheral end of the first spiral conductor;

a second conductor formed on the top surface of the substrate;

a third conductor formed on the bottom surface of the substrate and connected to an outer peripheral end of the second spiral conductor;

a first through-hole conductor connected between an inner peripheral end of the first spiral conductor and an inner peripheral end of the second spiral conductor;

a second through-hole conductor connected between the second conductor and the third conductor;

a first insulating layer formed on the top and bottom surfaces of the substrate to cover the first and second spiral conductors and the first to third conductors;

a second insulating layer formed on the top and bottom surfaces of the substrate with an intervention of the first insulating layer;

first and second external electrodes formed on the second insulating layer;

a first bump electrode connected between the first conductor and the first external electrode; and a second bump electrode connected between the second conductor and the second external electrode.

13. The coil component as claimed in claim 12, further comprising:

a fourth conductor formed on the bottom surface of the substrate; and a third through-hole conductor connected between the first conductor and the fourth conductor.

14. The coil component as claimed in claim 13, wherein each of the first and second conductors is curved along an outermost turn of the first spiral conductor, and each of the third and fourth conductors is curved along an outermost turn of the second spiral conductor.

15. The coil component as claimed in claim 12, wherein the second insulating layer includes a metal magnetic powder.

16. The coil component as claimed in claim 12, wherein the second insulating layer has a main surface that is substantially parallel to the top and bottom surfaces of the substrate and a side surface that is substantially perpendicular to the main surface, and wherein the first and second external electrodes are selectively formed on the main surface of the second insulating layer so that the side surface of the second insulating layer is free from the first and second external electrodes.

17. The coil component as claimed in claim 12, wherein the first spiral conductor has one of a clockwise rotation and a counterclockwise rotation from the outer peripheral end to the inner peripheral end viewed from the top surface of the substrate, and the second spiral conductor has the other of the clockwise rotation and the counterclockwise rotation from the outer peripheral end to the inner peripheral end viewed from the top surface of the substrate.

18. The coil component as claimed in claim 12, wherein the substrate includes a glass cloth.

* * * * *